US005609312A

United States Patent [19]

Arlton et al.

[11] Patent Number: 5,609,312

[45] Date of Patent: Mar. 11, 1997

[54] MODEL HELICOPTER

[76] Inventors: Paul E. Arlton; David J. Arlton, both of 1132 Anthrop Dr., West Lafayette, Ind. 47906

[21] Appl. No.: 292,718

[22] Filed: Aug. 18, 1994

Related U.S. Application Data

[63] Continuation-in-part of Ser. No. 233,159, Apr. 25, 1994, which is a continuation-in-part of Ser. No. 770,013, Sep. 30, 1991, Pat. No. 5,305,968.

[51] Int. Cl.[6] ..... B64C 1/14; B64C 27/06; B64C 27/82; B64C 25/52

[52] U.S. Cl. ..... 244/17.11; 244/17.19; 244/189; 244/108; 244/119; 244/131; 244/132

[58] Field of Search ..... 244/17.11, 17.17, 244/17.19, 17.21, 189, 108, 119, 120, 121, 131, 132, 133

[56] References Cited

U.S. PATENT DOCUMENTS

| | | | |
|---|---|---|---|
| 2,384,516 | 9/1945 | Young . | |
| 2,689,099 | 9/1954 | Lightfoot . | |
| 3,004,736 | 10/1961 | Culver et al. . | |
| 3,027,948 | 4/1962 | Goland et al. . | |
| 3,127,696 | 2/1964 | Pagliuso . | |
| 3,144,223 | 8/1964 | Nichols . | |
| 3,211,235 | 10/1965 | Bretl . | |
| 3,528,633 | 9/1970 | Knemeyer . | |
| 3,532,302 | 10/1970 | Dean . | |
| 4,270,711 | 6/1981 | Cresap et al. | 244/17.17 |
| 4,272,041 | 6/1981 | Mabuchi et al. . | |
| 4,579,301 | 4/1986 | Brand | 244/119 |
| 4,706,907 | 11/1987 | Kopylov | 244/49 |
| 4,759,514 | 7/1988 | Burkam . | |
| 5,037,041 | 8/1991 | Unterhitzenberger | 244/120 |
| 5,301,900 | 4/1994 | Groen et al. | 244/17.25 |
| 5,358,201 | 10/1994 | Brown, Sr. | 244/108 |
| 5,381,988 | 1/1995 | Kattas | 244/17.11 |

FOREIGN PATENT DOCUMENTS

| | | |
|---|---|---|
| 2332991 | 1/1974 | Germany . |
| 4-31197 | 2/1992 | Japan . |
| 1205263 | 9/1970 | United Kingdom . |

OTHER PUBLICATIONS

Sales brochure for X–Cell Gas produced by Nick Sacco. One page. Date unknown.

Sales brochure for GMP's New World Class Contest Helicopter Series contained in GMP's 1989 catalogue. Two pages.

Sales brochure for GMP Legend Series contained in GMP's 1990 catalogue, p. 7 and cover page.

Building Plans for the Champion Model Helicopter, (No. 3800), produced by Schluter. Three pages. Date unknown.

Sales brochure for Concept 60SR produced by Kyosho Corporation. One page. Date unknown.

Basic Assembly Manual for Rebel Helicopter produced by Gorham Model Products, Inc. Sixteen Pages. Aug., 1989.

Instruction Manual, general information, and Building Plans for XL–PRO Graphite X–CELL produced by Miniature Aircraft U.S.A. Five pages. Date unknown.

Building plans for XL–PRO produced by Miniature Aircraft U.S.A. Two pages. 1994.

(List continued on next page.)

*Primary Examiner*—Andres Kashnikow
*Assistant Examiner*—Virna Mojica
*Attorney, Agent, or Firm*—Barnes & Thornburg

[57] ABSTRACT

A fuselage structure for use on a model helicopter includes a longitudinally extending keel defined by a vertical flat plate oriented to lie in parallel relation to a longitudinal axis of the model helicopter. A radio control system component is mounted to the vertical flat plate. The fuselage structure also includes a laterally extending floor perpendicular to the keel, a front bulkhead appended to the keel and a forward end of the floor, and a firewall appended to the keel and a rearward end of the floor. A landing gear assembly is coupled to the fuselage structure at a junction positioned to lie adjacent to a forward portion of a bottom edge of the keel.

92 Claims, 18 Drawing Sheets

OTHER PUBLICATIONS

Information concerning the Whisper Electric Helicopter distributed by Hobby Dynamics Distributors, *Rotory Modeler,* p. 54, date unknown and sales brochure, two pages, date unknown.

Hobby Lobby International, Inc. video showing Sport 500 Helicopter and Hughes 500 Electric Helicopter.

Sales brochure for the HLA444 Hobby Lobby/MFA Sport 500 Collective, Mark 2 contained in the Nov. 1994 Model Airplane News.

Sales brochure for the HLA400 Hobby Lobby/MFA Sport 500 Helicopter contained in the Jan. 1990 Model Aviation sales catalog, p. 163, in the Hobby Lobby International, Inc. advertisement section.

Assembly Instruction Manual for Cricket R/C Helicopters produced by Gorham Model Products, Inc. Five pages. Date unknown.

Building Plans for Enforcer ZR produced by Kalt Helicopters. One page. Date unknown.

"Rotory Debut: Great Planes Concept 10", *Rotory Modeler,* May, 1992, p. 33.

"Rotory Debut: New Push/Pull System from TSK", *Rotory Modeler,* May, 1992, p. 69.

Sales brochure for the Whisper Electric helicopter distributed by Hobby Dynamics Distributors. One Page. Date unknown.

*Rotary Modeler,* May/Jun., 1992. One page.

Building Instructions for the Champion model helicopter produced by Hubschrauber Schluter. Two pages. Date unknown.

Building Plans for X–Cell thirty and forty series model helicopter produced by Miniature Aircraft USA, 1989, two pages.

Sales brochure for the Petit–Helicopter, Sports Flight Helicopter, and helicopter accessories contained in the sales catalog for Hirobo Limited. Three pages. Date unknown.

Rock, Gene, SSP–5, *American Aircraft Modeler,* Mar., 1973, pp. 41–45 and 76–79.

*R/C Feel Out The Helicopter A to Z,* two page sales brochure for model helicopters produced by Kyosho Co. of Kanagawa Pretecture. Date unknown. Illustrations in brochure show the structure of the helicopter including the main rotor, tail rotor, frame, and landing gear.

Information concerning the Graupner Heim helicopter contained *Neuheiten '91,* pp. 22–23. Illustrations show the structure of the helicopter including the main rotor, frame, and landing gear.

21
39

22
154
156
152
23

29
28
27

24
40
25

25

144
47
37
35
146
36
37
37
37
37
152
34
37
48
20
32
148
33
31
142
30

127
133
150
133
140
127
141
139
129
131
128
131
140
141
130
126
139
4

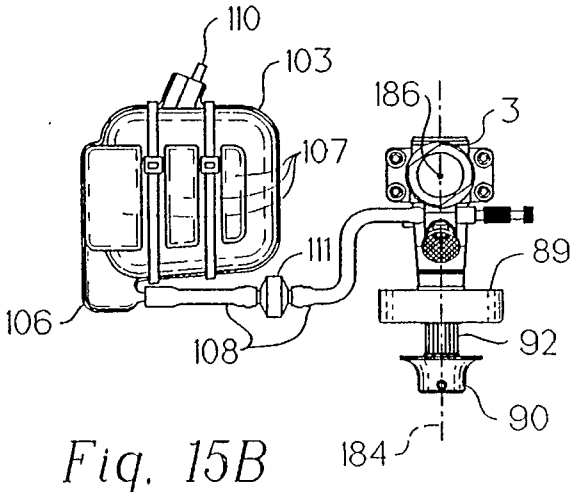
Fig. 15B
Fig. 15A
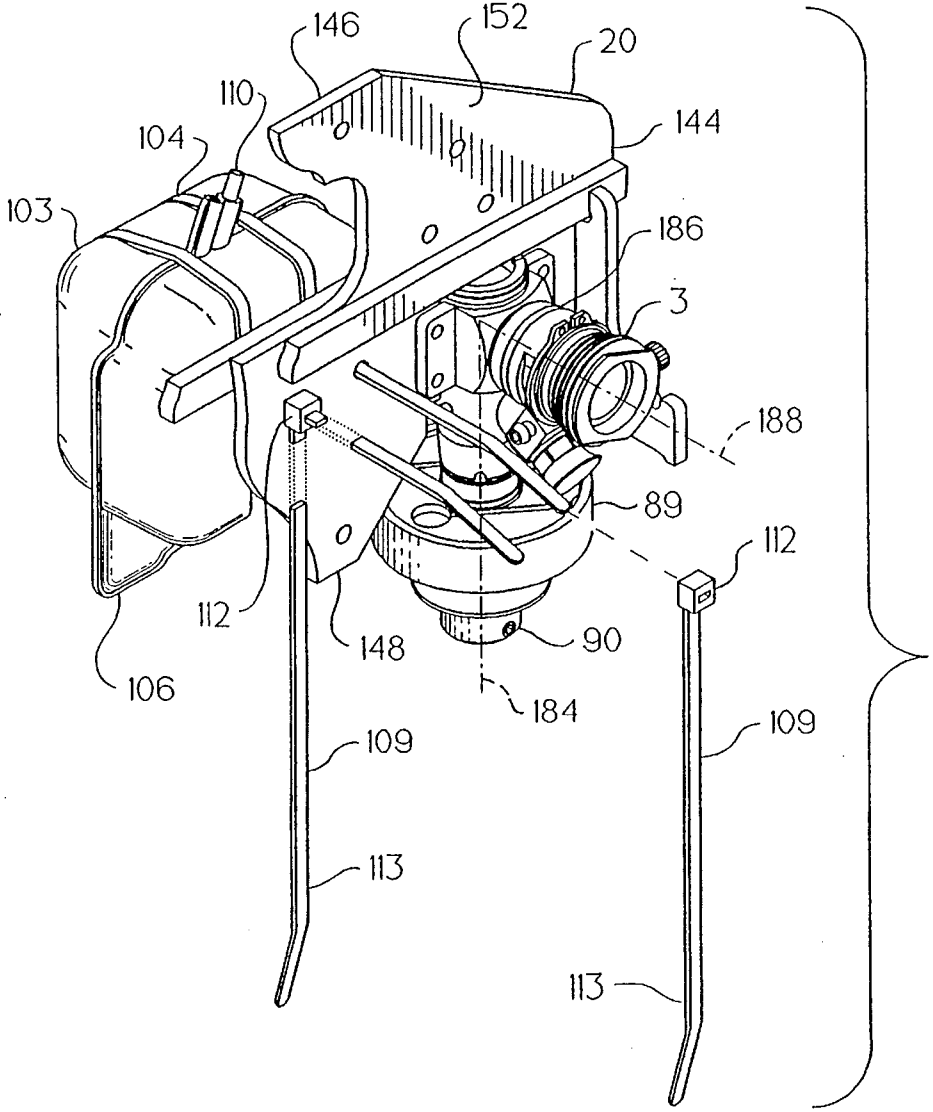

MODEL HELICOPTER

This application is a continuation-in-part application of U.S. application Ser. No. 08/233,159 filed Apr. 25, 1994, which is a continuation-in-part application of U.S. application Ser. No. 07/770,013 filed Sep. 30, 1991, now U.S. Pat. No. 5,305,968.

BACKGROUND AND SUMMARY OF THE INVENTION

This invention relates to the configuration and construction of model helicopters. More particularly, this invention relates to a model helicopter fuselage, landing gear, and power train elements that simplify construction and reduce manufacturing costs.

Helicopters are flying machines having the ability to hover and fly forwards, backwards, and sideways. This agility stems from the multiple capabilities of the main rotor system. Since the invention of helicopters in the 1930's considerable effort has been expended advancing helicopter technology, with a substantial percentage of that effort concentrated on main rotor systems.

While the technology of full-size helicopters progressed for decades, model helicopters remained impractical for lack of suitable engines, radio control equipment, and construction materials. Model helicopter designers often copied the designs of full-size helicopters without understanding the basic differences between full size and model aircraft. As a result, scaled-down model helicopters were typically unstable and underpowered.

In the 1970's hobbyists developed the first practical model helicopters. Lighter radio control equipment, more powerful engines, and systematic engineering all contributed to early successes. Much of model helicopter design, however, is rooted in tradition. Even though helicopter technology has advanced considerably since that time, the designs and design philosophies of that era are still in widespread use.

Model helicopters currently available are typically complex and expensive. As a result, the market for model helicopters is relatively small. Many helicopter manufacturers cater to wealthy and sophisticated hobbyists in order to sell their products. Although many less affluent hobbyists are interested in helicopters, helicopters are usually beyond their economic means and skill level. Reducing the overall cost and complexity of model helicopters would bring them within reach of a large group of hobbyists.

Much of the complexity and cost of helicopters is concentrated in the main rotor system, but a great deal is added by the basic fuselage structure. The structure of a typical model helicopter fuselage is a framework stamped from aluminum sheet metal or molded of reinforced plastic, and assembled with nuts and bolts. Radio control components such as the battery, receiver, and servos bolt onto shelves or extensions of the framework. Mechanical components such as the engine and drive train are usually mounted inside the framework. Landing gear is typically constructed of aluminum and plastic. All-aluminum landing gear is relatively weak and easily damaged, while plastic landing gear is typically thick and bulky.

While structurally strong, traditional model helicopter fuselage construction often involves assembling many separate pieces with a multitude of fasteners and sometimes adhesives. A particular drawback of metal framework is the tendency of the framework to bend when the model helicopter crashes. Since the fuselage usually must be entirely disassembled to straighten bent framework, repairs to the model helicopter can be very time consuming. Simplified model helicopter fuselage structure has the triple benefit of reducing manufacturing cost, assembly time, and repair time.

Simplified fuselage structure also leads to simplified mounting of the various mechanical components attached to the fuselage. Simplified fuselage structure combined with a well-planned layout for radio system components and engine drive train components can greatly reduce the number of parts in the helicopter and consequently manufacturing cost and assembly time.

Given the cost and complexity of model helicopters currently available, what is needed are simple, sturdy, and light-weight elements for model helicopter structures and drive train components.

In accordance with the present invention, there is provided a model helicopter including an improved fuselage having a central keel structure supporting radio-control system components, mechanical drive train components including a source of motive power, landing gear, canopy, and a tail rotor. This improved fuselage provides a simplified structure for model helicopters.

In preferred embodiments, the fuselage includes a canopy support frame attached to the keel. The canopy fits over and attaches to the canopy support frame to cover the components supported by the keel including the radio-control system components, and the mechanical drive train components.

Advantageously, the fuselage further includes landing gear supports attached to the keel. These landing gear supports are also attached to front and rear landing gear struts which support the model helicopter when it is resting on the ground.

In preferred embodiments of the present invention, the mechanical drive train components include an engine assembly, a gear assembly, and a main rotor shaft for driving a main rotor. It will be understood that the onboard model helicopter engine is started by transferring rotation from a separate starter motor to the model helicopter engine.

Advantageously, the drive train includes an improved starter cone linked to the model helicopter engine that engages the starter motor and transmits the rotation of the starter motor to the engine. This improved starter cone includes a concave side wall capable of centering the starter cone in the starter motor while the starter motor is providing power to the engine.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 3B is a plan view of a floor that attaches to a bottom side of the keel;

FIG. 3C is a side elevation view of a bulkhead reinforcement;

FIG. 3D is a side elevation view of a landing gear bulkhead that attaches to the bottom side of the keel and showing (in phantom) where the bulkhead reinforcement shown in FIG. 3C is appended to the landing gear bulkhead;

FIG. 3E is a side elevation view of first and second bulkhead firewalls that are mounted to opposite sides of the elongated, flat keel and are positioned to lie at the rear edge of the canopy and adjacent to the model helicopter engine;

FIG. 3F is a side elevation view of a landing gear bracket that attaches to the bottom side of the elongated, flat keel;

FIG. 11 is a perspective exploded view of the landing gear struts and the landing gear skids;

FIG. 11C is a perspective exploded view of the skid being rotated 90° so that the boot of the landing gear skid engages the lower foot portion of the landing gear strut;

FIG. 15A is an enlarged perspective view of a rear section of the model helicopter of FIG. 1 showing installation of the engine and fuel tank on the keel, with the engine heat sink and all parts forward of the engine and fuel tank removed for clarity;

FIG. 15B is a side elevation view of the engine and fuel tank of a model helicopter in accordance with the present invention, with the engine heat sink and all other parts of the present invention omitted for clarity;

DETAILED DESCRIPTION OF THE DRAWINGS

A model helicopter in accordance with the present invention includes an improved fuselage having a longitudinally extending keel. The keel supports radio control units, servo control units, drive train mechanisms, and other components necessary for helicopter operation. The fuselage further includes a canopy support frame for supporting a canopy and landing gear supports for supporting a landing gear assembly attached to the keel.

Figure 1:
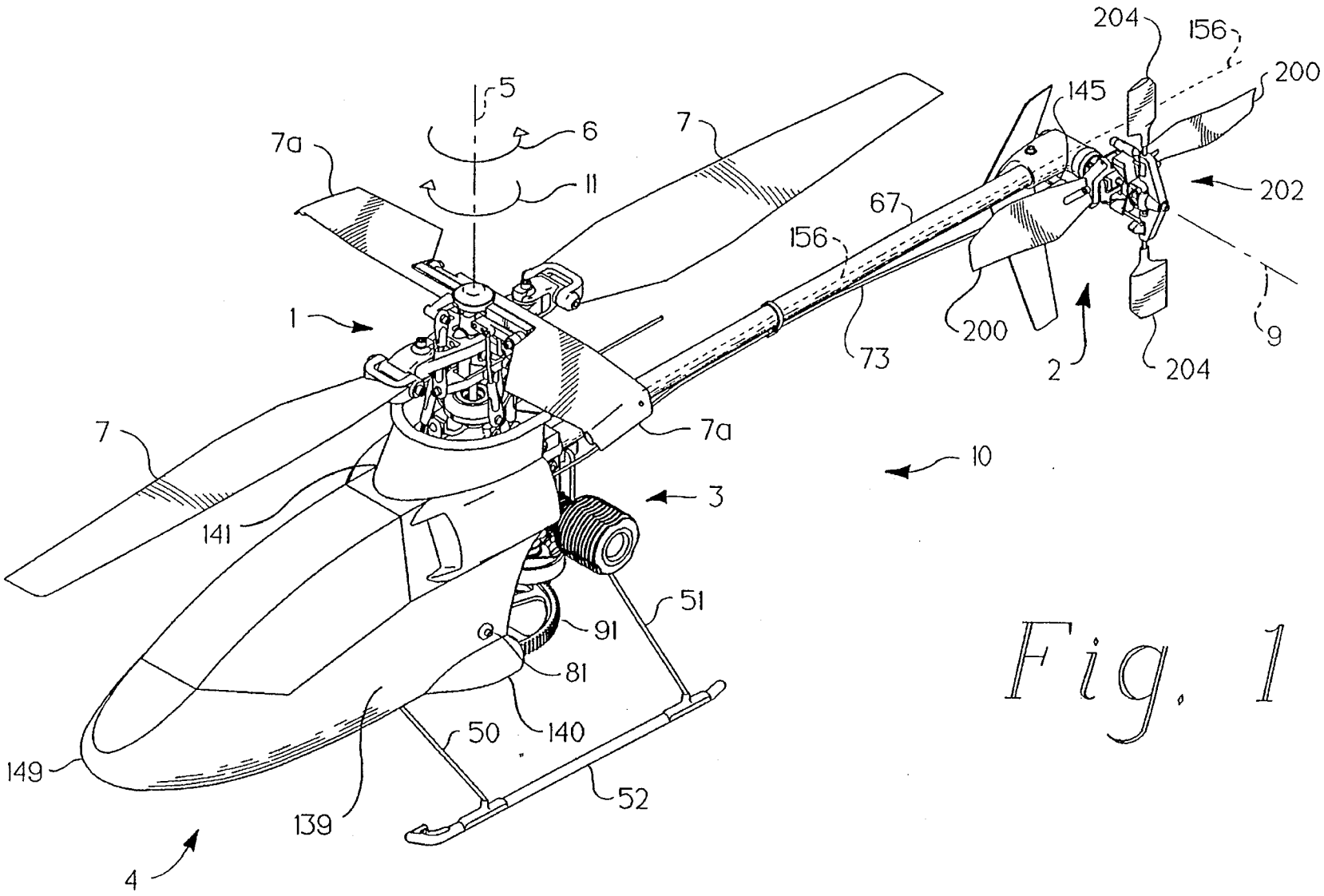
FIG. 1 is a perspective view of a model helicopter in accordance with the present invention showing a main rotor, tail rotor mounted at one end of the tail boom, canopy, and landing gear.

A model helicopter 10 in accordance with the present invention is shown in FIG. 1. Helicopter 10 is commonly designed to include large main rotor 1 which rotates about main rotor axis 5 and which lifts helicopter 10 into the air, and smaller tail rotor 2 which rotates about tail rotor axis 9 to counteract the torque produced by main rotor 1 and steer helicopter 10. Illustratively, main rotor 1 includes a pair of rotor blades 7 and a pair of shorter subrotor blades 7*a*, and tail rotor 2 includes a pair of tail rotor blades 200. A gyro stabilizer 202 including a pair of aerodynamic gyro paddles 204 is mounted on tail rotor 2 as shown in FIG. 1.

Figure 2:
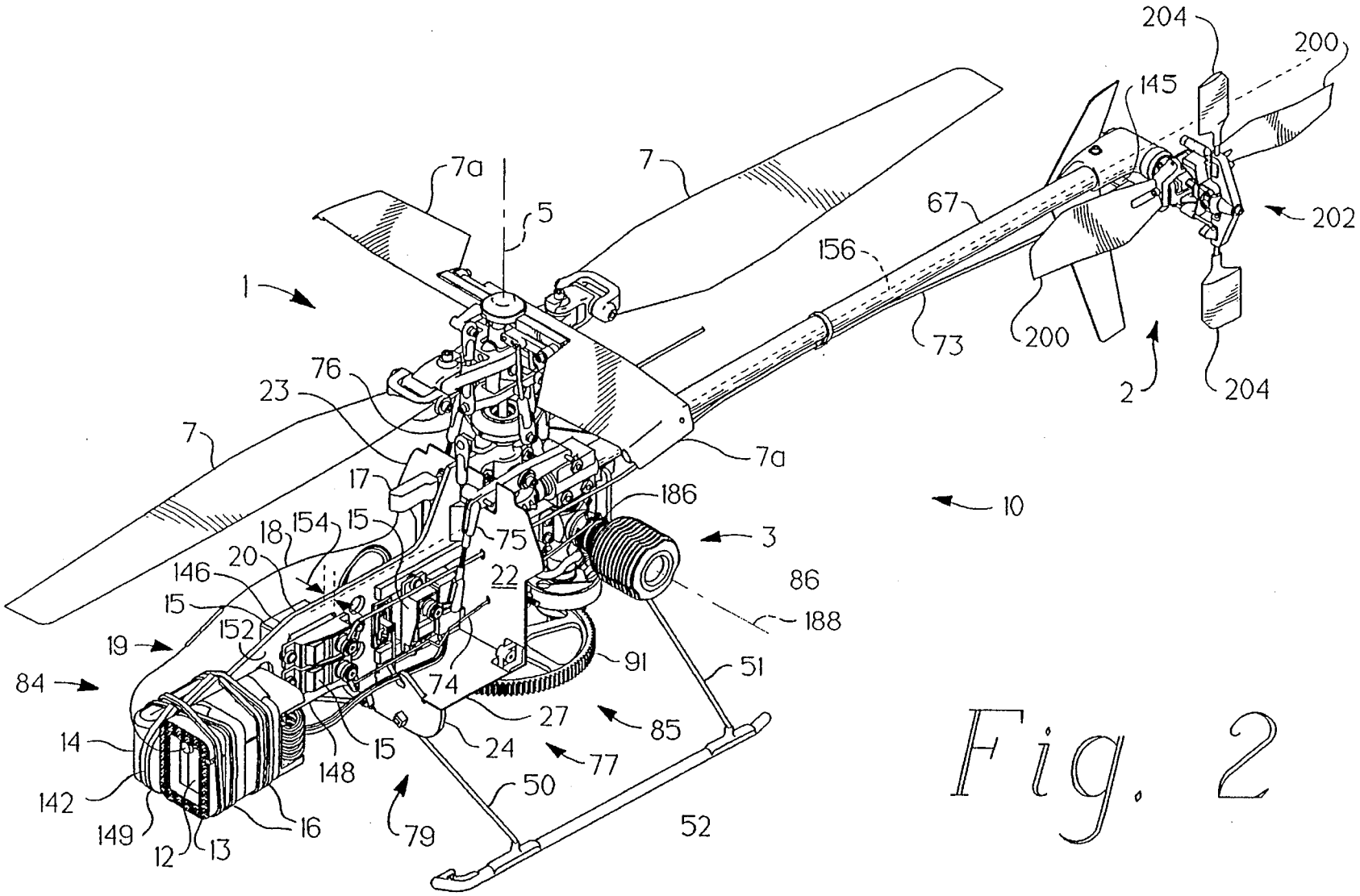
FIG. 2 is a perspective view of the model helicopter shown in FIG. 1 with the canopy removed to show a fuselage including an elongated, flat, vertically oriented keel having radio-control and servo-control elements appended to it.

Tail rotor 2 is mounted at a rear end of tail boom 67 as shown in FIGS. 1 and 2. A longitudinal helicopter axis 156 extends through tail boom 67 along its length and through main rotor axis of rotation 5, and lies in perpendicular relation to main rotor axis of rotation 5 as shown, for example, in FIG. 12. Longitudinal helicopter axis 156 intersects main rotor axis of rotation 5 at point 83 as shown, for example, in FIG. 12. Both main rotor 1 and tail rotor 2 are driven by an engine 3 usually located within the helicopter fuselage (body) near the vertical main rotor shaft. A detailed description of a suitable helicopter main rotor system is disclosed in Paul E. Arlton's U.S. patent application Ser. No. 08/233,159 filed Apr. 25, 1994, which is hereby incorporated by reference herein. A detailed description of suitable tail rotor systems are disclosed in U.S. Pat. No. 5,305,968 to Paul E. Arlton and in a Paul E. Arlton et al. U.S. patent application entitled "Yaw Control and Stabilization system for Helicopters" submitted as a separate paper herewith, both of which are hereby incorporated by reference herein.

A streamlined canopy 4 covers a front portion of helicopter 10 and includes a body 139, gear shroud 140, and main rotor shroud 141 as shown in FIG. 1. A radio-controlled command unit and other drive mechanisms are contained inside canopy 4 as shown in FIG. 2. Canopy 4 is designed for use on a model helicopter such as helicopter 10 to protect the radio-control unit and provide the appearance of a pilot-carrying portion of helicopter 10. Canopy 4 does not extend back to tail rotor 2 on some helicopters 10. When sitting on the ground, helicopter 10 is supported by front landing gear strut 50 and rear landing gear strut 51 attached to spaced-apart skids 52 with one skid 52 positioned on each side of helicopter 10.

In operation, main rotor 1 rotates rapidly about main rotor axis 5 in rotation direction 6. As it does so, main rotor blades 7 act like propellers or fans moving large amounts of air downward thereby creating a force that lifts helicopter 10 upward. The torque (reaction force) created by rotating main rotor 1 in rotation direction 6 tends to cause the body of helicopter 10 to swing about main rotor axis 5 in direction 11 as shown in FIG. 1. When trimmed for steady hovering flight, tail rotor 2 creates enough thrust force to cancel exactly the torque produced by main rotor 1 so that helicopter 10 can maintain a constant heading. Decreasing or increasing the thrust force of tail rotor 2 causes helicopter 10 to turn (rotate about axis 5) in the desired direction.

Components used to control main rotor 1, tail rotor 2, and engine 3 are shown in FIG. 2 which shows helicopter 10 of FIG. 1 with canopy 4 removed. To control model helicopter 10, a pilot manipulates small joysticks on a hand-held radio transmitter (not shown) to send commands to radio receiver 12 through antenna 17 and antenna wire 18. Radio receiver 12 is usually wrapped in vibration-absorbing foam 13. Radio receiver 12 relays these commands to electro-mechanical servo actuators 15 (hereinafter called servos) to control main rotor 1, tail rotor 2, and engine 3. Battery 14 provides the electrical power necessary to operate radio receiver 12 and servos 15. Rubber bands 16 encircle battery 14 and receiver 12 and secure them to helicopter 10.

Figure 12:
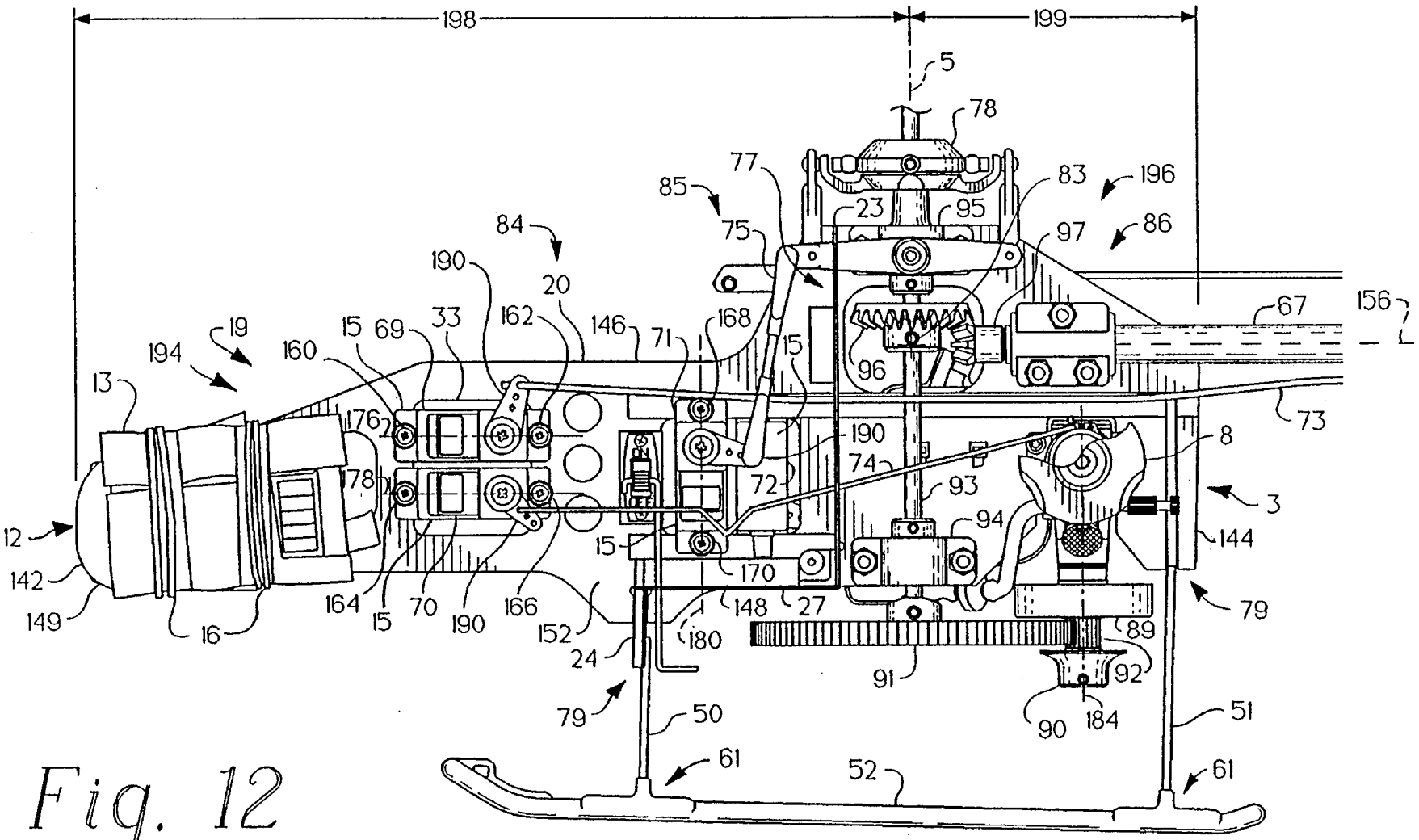
FIG. 12 is a left side elevation view of the model helicopter of FIGS. 1 and 2 showing the elongated, flat, vertical keel and relative positions of radio system components, drive train components and structural components along with the vertical main rotor shaft, horizontal tail boom, and landing gear wherein the engine heat sink is shown in partial cutaway to expose throttle pushrod detail and electrical wiring between radio components is omitted for clarity.
Figure 13:
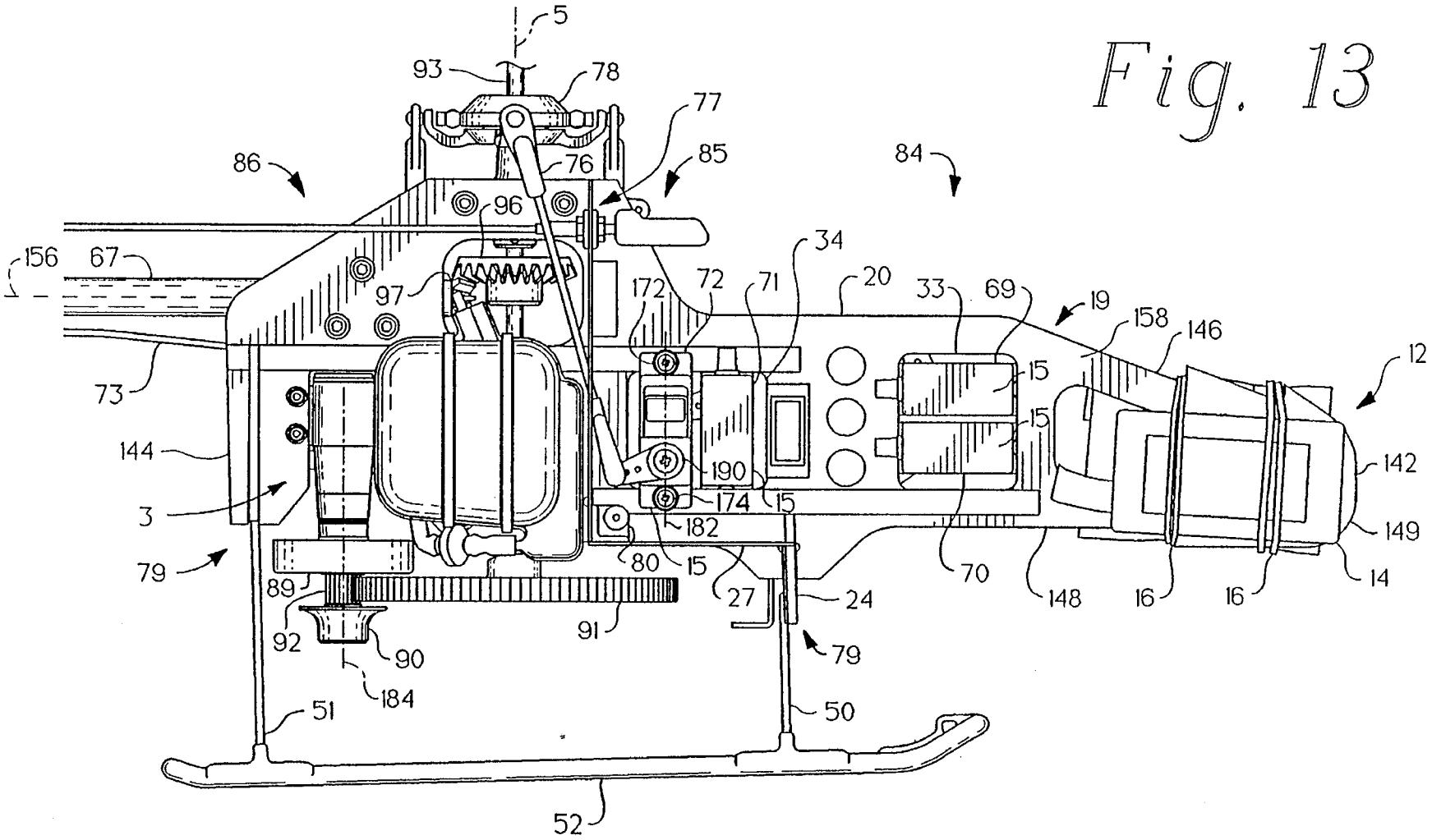
FIG. 13 is a right side elevational view of the model helicopter of FIGS. 1 and 2 showing relative positions of radio system components, drive train components, structural components, and fuel system components, wherein electrical wiring between radio components is omitted for clarity and landing gear attachment detail is also removed for clarity.
Figure 14:
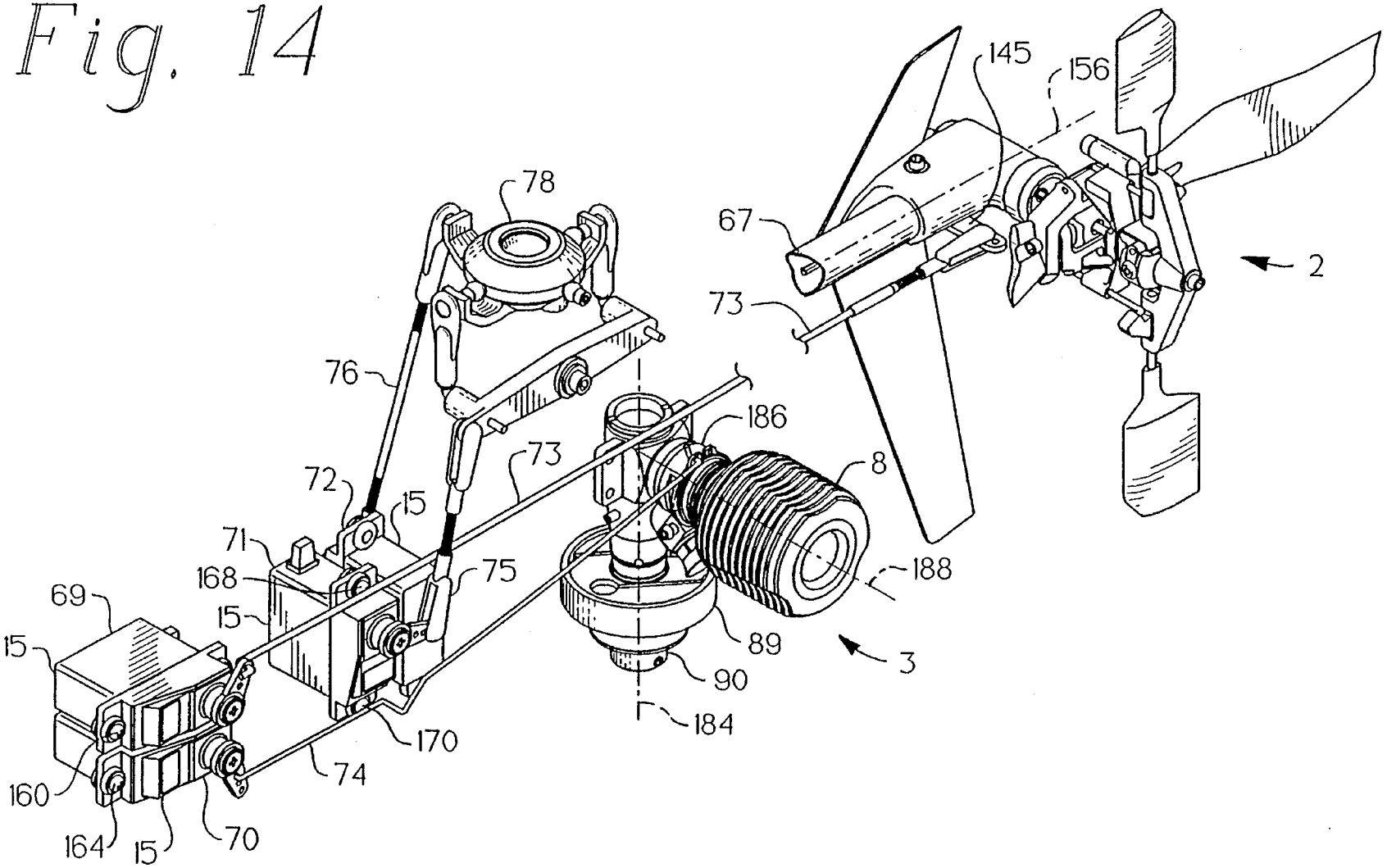
FIG. 14 is a perspective view of a linkage system in accordance with the present invention showing elements of the radio system, swashplate (main rotor head control system), engine, and tail rotor, with all structural elements removed for clarity.

The four basic control functions required to fly a model helicopter 10 (fore-aft cyclic, right-left cyclic, tail rotor 2, and throttle/collective) each require a separate servo 15. Push-pull rods 73–76 and bellcranks 145 connect servos 15 to main rotor 1, tail rotor 2 and engine 3. Each servo 15 includes an output control arm 190 connected to push-pull rods 73–76 as shown, for example, in FIGS. 12 and 13. Fore-aft cyclic servo 71 and right-left cyclic servo 72 control main rotor 1 and cause helicopter 10 to tilt forward or backward, and right or left respectively as shown in FIGS. 12–14. Tail rotor servo 69 rotates helicopter 10 about rotation axis 5 like a steering wheel on a car. Throttle/collective servo 70 controls the altitude and speed of helicopter 10 by adjusting the speed of engine 3 and/or the pitch of main rotor blades 7.

Fuselage 19 forms the structural backbone of helicopter 10. All mechanical and electronic systems of helicopter 10 are mounted to and almost completely obscure fuselage 19 as shown in FIG. 2. Fuselage 19 includes forward section or portion 84 supporting radio receiver 12 and servos 15, middle section or portion 85 having the canopy support frame 77, and rear section or portion 86 supporting engine 3. To better understand the fuselage structure of helicopter 10, it is easiest to look at individual pieces of fuselage 19 separated from the rest of helicopter 10.

FIGS. 3A–3F show fuselage 19 structural elements comprising longitudinally extending elongated keel 20, landing gear bracket 21, firewall left and right halves 22 and 23, landing gear bulkhead 24, bulkhead reinforcement 25, and floor 27. Keel 20 is defined by a single flat plate that extends along a keel plane defined by left-side keel surface 152 and right-side keel surface 158 as shown, for example, in FIGS. 2, 5, 8, and 9. The keel plane is offset from longitudinal axis 156 of model helicopter 10. Keel 20 includes a first section 194 and a second section 196. First section 194 extends from main rotor axis of rotation 5 to front end 142 of keel 20 a first length 198 substantially parallel to longitudinal axis 156 of model helicopter 10. Second section 196 extends from main rotor axis of rotation 5 to rear end 144 of keel 20 a second length 199 substantially parallel to longitudinal axis of model helicopter 10. First length 198 of first section 194 is about two times longer than second length 199 of second section 196. Keel 20 includes a front end 142, rear end 144, top end 146, bottom end 148, left-side keel surface 152, and right-side keel surface 158 as shown, for example, in FIGS. 2, 3A, 4, 5, 8, 9, 12, 13, and 15A. Left-side keel surface 152 and right-side keel surface 158 of keel 20 extend longitudinally between front end 142 and rear end 144 substantially parallel to longitudinal helicopter axis 156 as shown, for example, in FIGS. 2, 12, and 13. Left-side keel surface 152 and right-side keel surface 158 extend vertically between bottom end 148 and top end 146 substantially parallel to main rotor axis of rotation 5 as shown, for example, in FIG. 12. Helicopter 10 includes a front end 149 that is situated adjacent to front end 142 of keel 20 as shown, for example, in FIGS. 1, 2, 8, 12, and 13. In the illustrated embodiment, longitudinal helicopter axis 156 is offset from left-side keel surface 152 and right-side keel surface 158. More specifically, longitudinal helicopter axis 156 is offset from left-side keel surface 152 by a distance 154 as shown, for example, in FIGS. 2 and 3E. Servos 69–71 are mounted to left-side keel surface 152 of keel 20 as shown, for example, in FIG. 12. Left-side keel surface 152 faces toward the output control arms 190 of servos 69–71 and longitudinal axis 156 of model helicopter 10. Servo 72 is mounted to right-side keel surface 158 of keel 20 to position output control arm 190 of servo 72 on the opposite side of keel 20 from output control arms 190 of servos 69–71 as shown, for example, in FIGS. 12 and 13. Floor 27 includes a forward end 28 facing toward the front section 84 of keel 20 and a rearward end 29 facing toward the rear section 86. Keel 20 is formed to include several apertures to reduce the weight of helicopter 10 and accommodate various mechanical and electronic system components. More specifically, keel 20 is formed to include weight-reduction holes 30, 31, and 32; servo bays 33 and 34; gear-clearance hole 35; engine cutout 36; and multiple bolt and alignment holes 37.

Figures 3A, 3B, 3C, 3D, 3E, 3F:
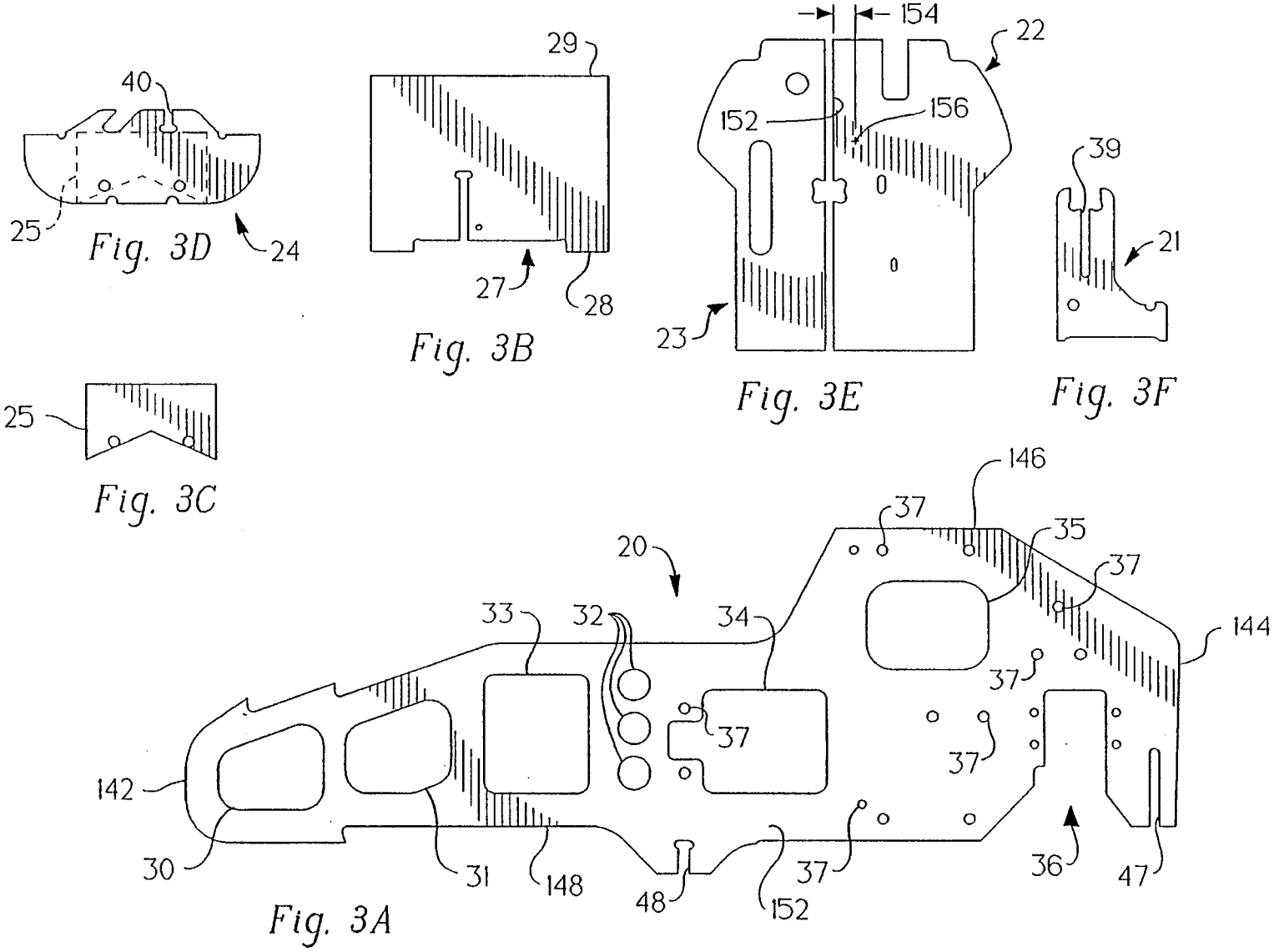
FIG. 3A is a side elevation view of the elongated, flat keel included in the model helicopter of FIGS. 1 and 2 showing various slots and apertures formed in the keel for holding various helicopter radio, control, and drive train components.
FIGS. 3B–3F are views of various pieces that mount onto the keel to support the canopy and the landing gear in the manner shown in FIGS. 2 and 5.

Bulkhead reinforcement 25 shown in FIG. 3C is glued to and reinforces bulkhead 24 as shown in phantom in FIG. 3D. In preferred embodiments of the present invention, all structural elements of fuselage 19 shown in FIG. 3 are made of aircraft-grade plywood. Keel 20, landing gear bracket 21, and landing gear bulkhead 24 are approximately three times as thick as the remaining elements to carry higher structural loads. In alternative embodiments of the present invention, composite materials such as fiber-reinforced plastics could be substituted for plywood.

Figure 4:
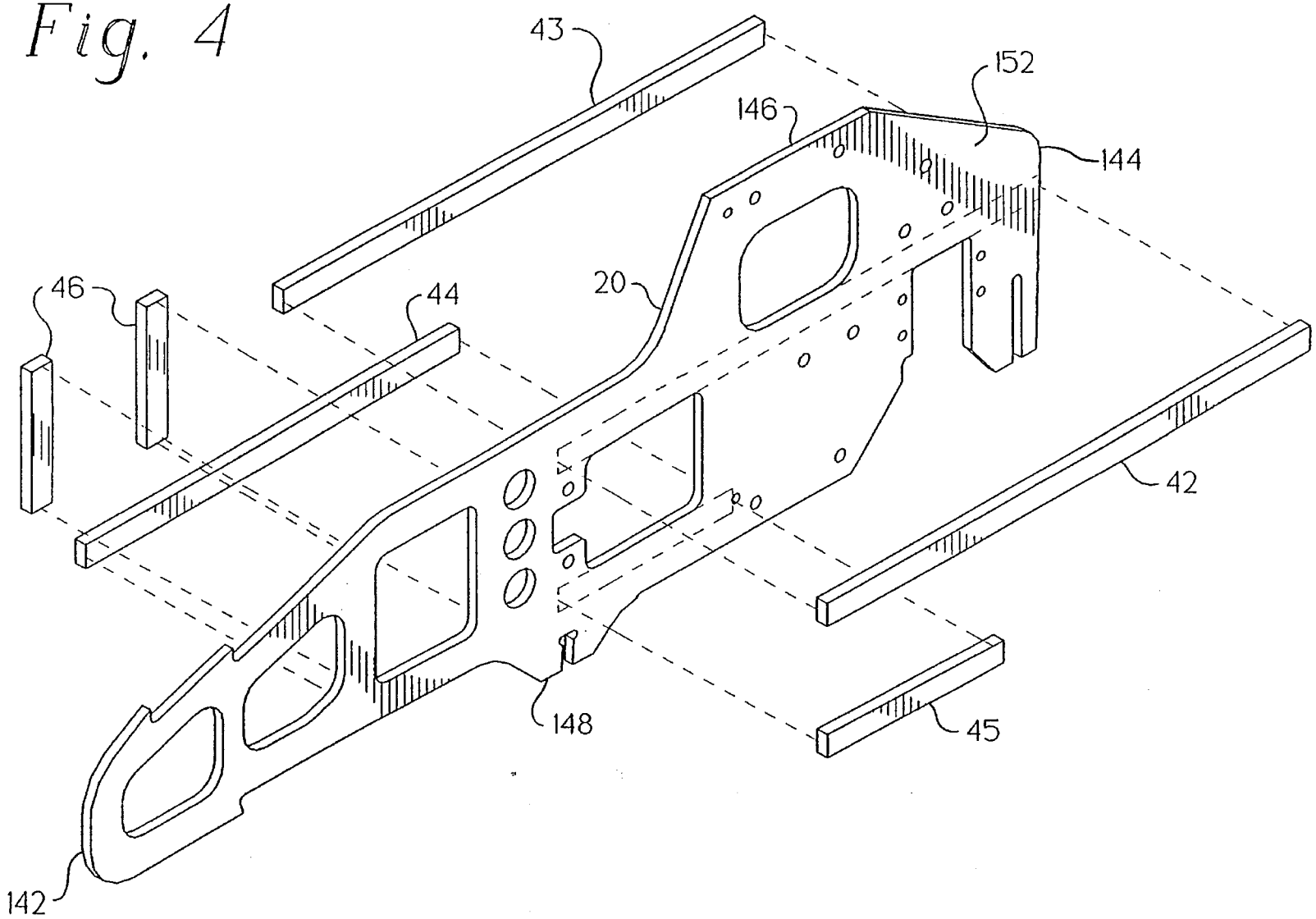
FIG. 4 is a perspective view of the elongated, flat keel showing the placement of stiffeners on the keel, with all other parts of the helicopter removed for clarity.

Fuselage 19 further includes keel stiffeners 42, 43, and 44 and servo risers 45 and 46 attached to keel 20 as shown in FIG. 4. Stiffeners 42, 43, and 44 primarily stiffen keel 20 longitudinally, while servo risers 45 and 46 provide raised mounting surfaces receptive to self-tapping mounting screws 160, 162, 164, 166, 168, 170, 172, and 174 used for mounting servos 15 as shown, for example, in FIGS. 12 and 13. In a preferred embodiment of the present invention, keel stiffeners 42, 43, and 44 and servo risers 45, 46 are strips of spruce wood and are attached to keel 20 with glue.

Figure 5:
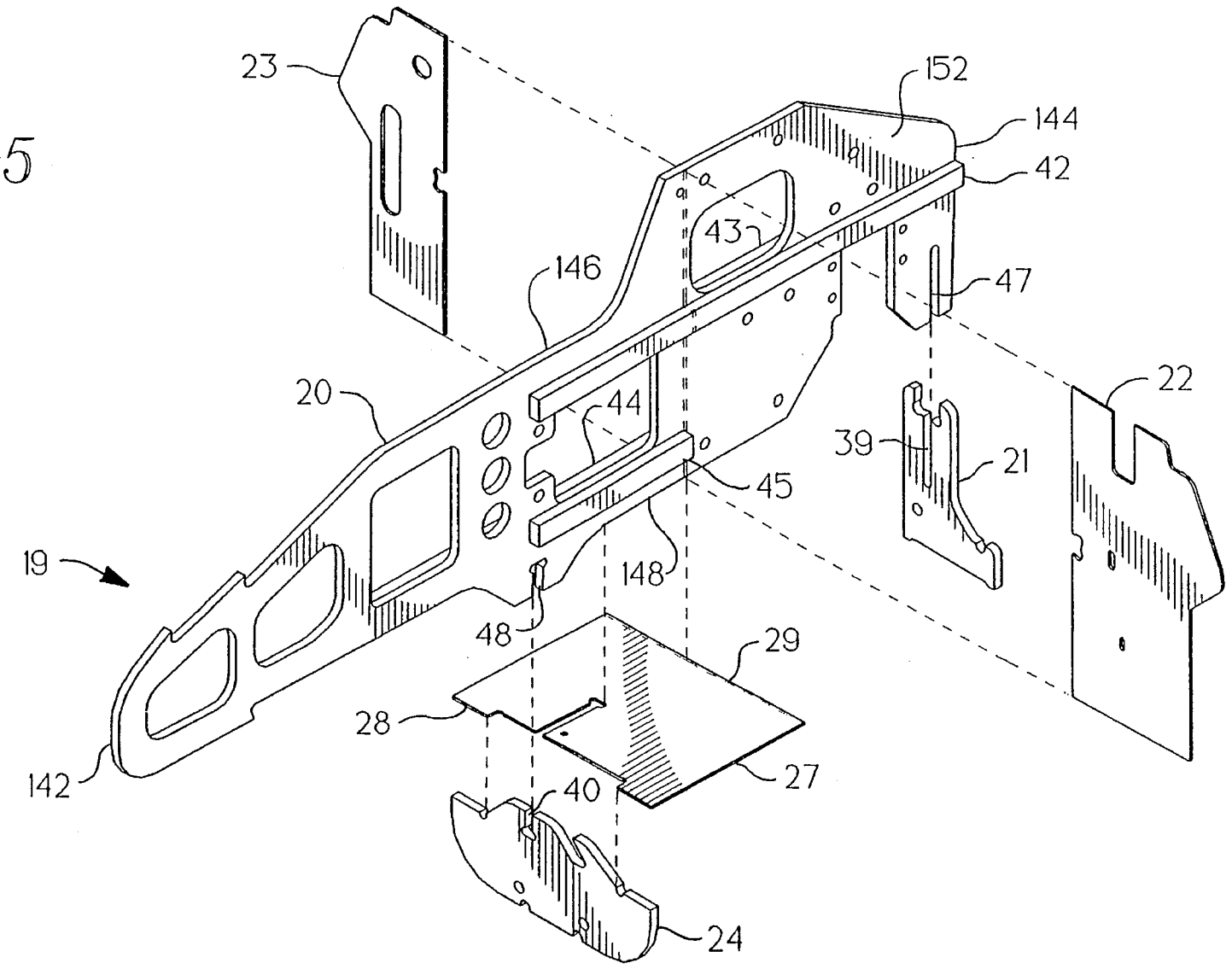
FIG. 5 is a view similar to FIG. 4 showing the orientation of the various fuselage structural elements shown in FIGS. 3B to 3F in relation to the keel and to each other.

The components of fuselage 19 are assembled as shown in FIG. 5. Landing gear bracket 21 is fixed (as by gluing) to keel 20 by inserting landing gear bracket 21 into alignment slot 47 formed in keel 20 until keel 20 extends completely into bracket slot 39 formed in landing gear bracket 21. In a similar fashion, landing gear bulkhead 24 is secured to keel 20 by connecting interlocking bracket slot 40 and alignment slot 48 formed in keel 20. Floor 27 is attached to landing gear bulkhead 24, keel 20, and firewall halves 22 and 23 which are also affixed to keel 20. Floor 27 is situated perpendicular to keel 20. After assembly, the structural elements shown in FIG. 5 are collectively referred to as fuselage 19. Alternate embodiments of the present invention are envisioned wherein fuselage 19 is made of plastic such as nylon or polycarbonate with bulkhead 24, firewalls 22, 23 and/or floor 27 elements molded integrally to keel 20, or attached with adhesives or mechanical fasteners.

Figures 6, 6A:
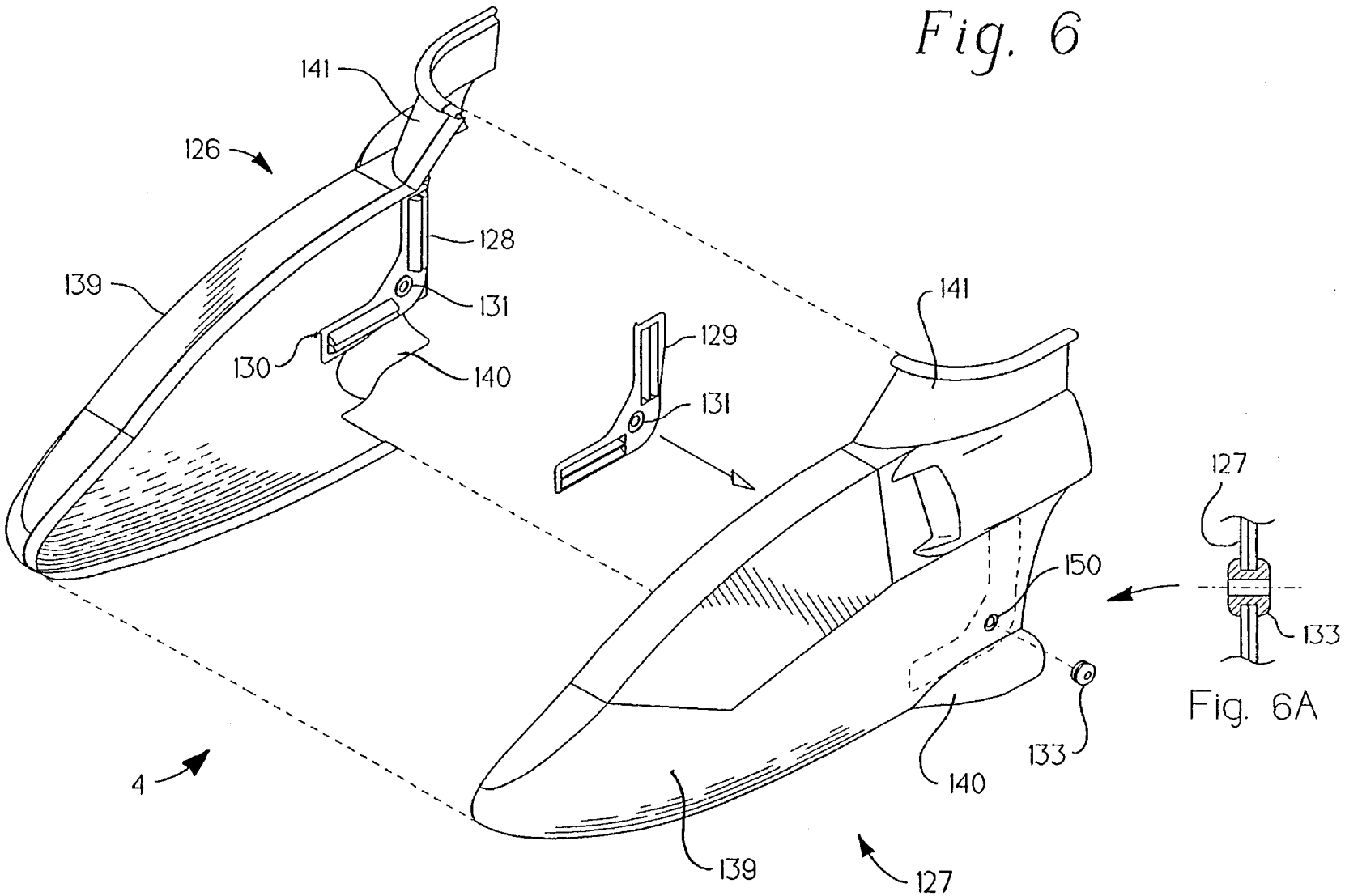
FIG. 6 is an exploded perspective view of the canopy of FIGS. 1 and 2 showing two canopy halves prior to assembly and showing the position of canopy mounting supports and mounting grommets.
FIG. 6A is a cross-sectional view of a mounting grommet installed in the canopy of FIGS. 1, 2, and 6.
Figures 8, 8A:
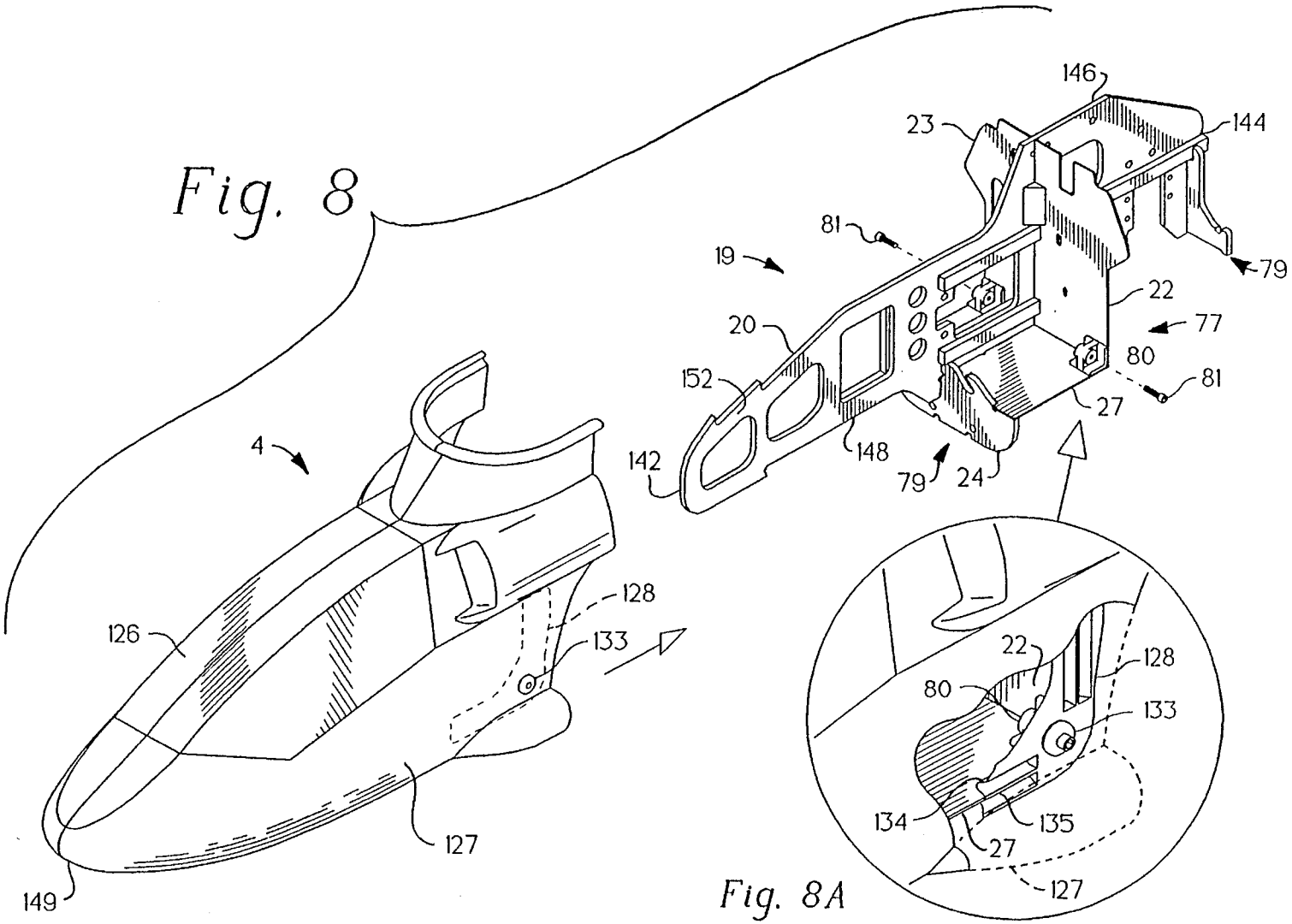
FIG. 8 is a perspective view showing attachment of the canopy to a keel carrying various fuselage structural elements, a portion of the fuselage structural elements which are assembled and mounted on the flat keel to act as a canopy support frame.
FIG. 8A is an enlarged perspective view of one part of the model helicopter of FIGS. 1, 2, and 8, with a portion of the canopy removed, showing the canopy attached to the canopy support frame.

The firewalls 22, 23, and floor 27 form a canopy support frame 77 to which canopy 4 attaches as shown in FIGS. 8 and 8A. Canopy 4 includes canopy halves 126, 127 as shown in FIG. 6. Canopy mounting supports 128, 129 are secured to the inside of each canopy half 126 and 127 to reinforce canopy 4 and act as mounting and alignment brackets for canopy 4 when attached to the canopy support frame 77.

Figure 7A:
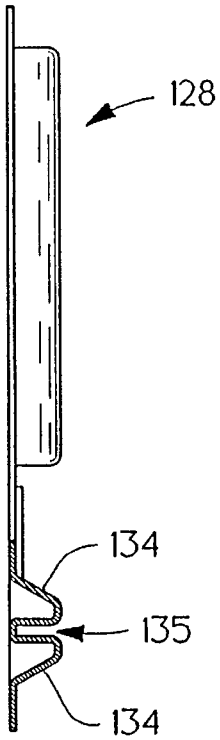
FIG. 7A is a sectional view taken along line 7A—7A of FIG. 7 showing a mounting groove that functions to attach the canopy mounting support to the model helicopter fuselage.
Figure 7:
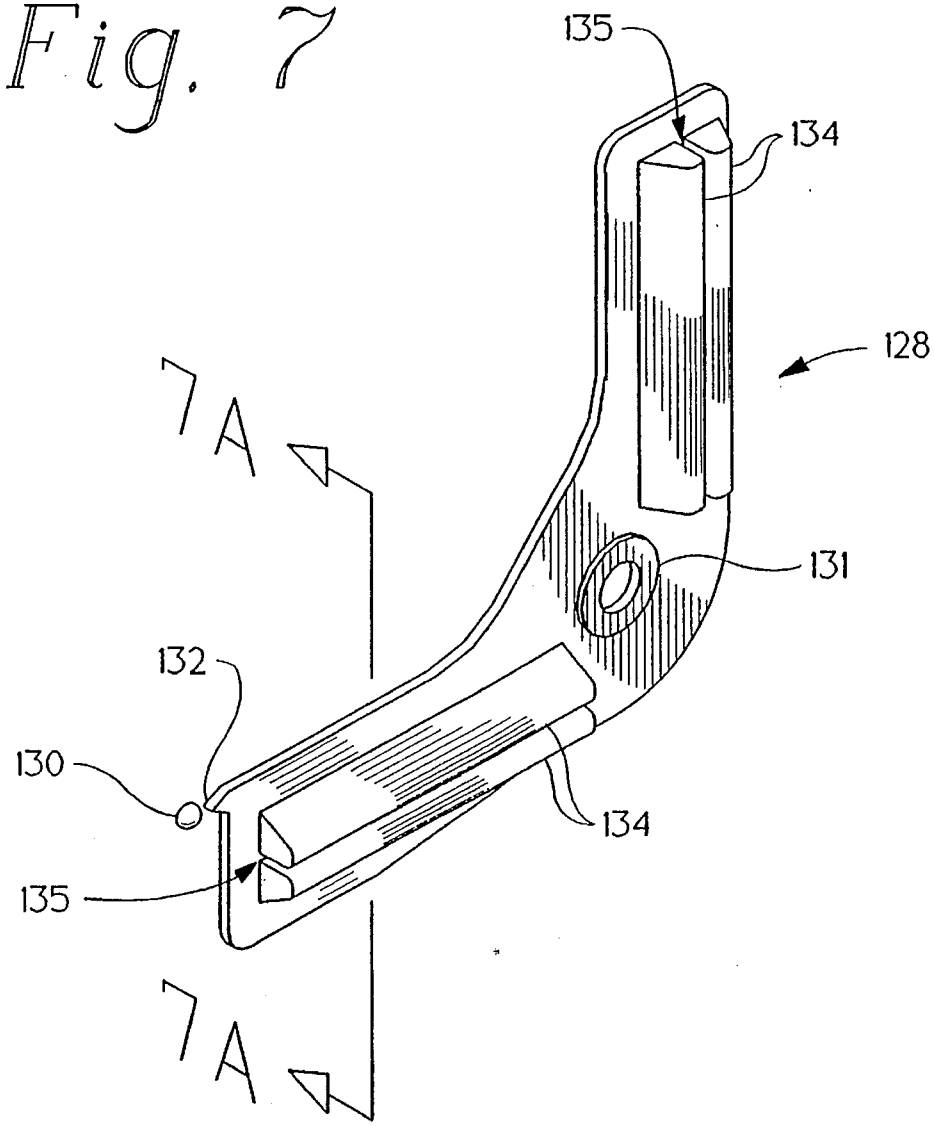
FIG. 7 is an enlarged perspective view of a canopy mounting support in accordance with the present invention.

Canopy mounting supports or doublers 128, 129 include alignment detent 131 and mounting ridges 134. Alignment detent 131 of canopy mounting support 128 engages a matching detent 150 formed in body 139 of canopy half 126. Alignment arrow 132 on mounting support 128 aligns with alignment mark 130 on the inside of canopy half 126 when mounting support 128 is properly aligned on the inside of canopy half 126 as shown in FIG. 7. Mounting ridges 134 form mounting grooves 135 receptive to floor 27 and firewall halves 22, 23 of the canopy support frame 77. Mounting grommet 133 is installed in each of alignment detents 131 as shown in FIG. 6A. In preferred embodiments of the present invention, mounting supports 128 are formed of sheet plastic identical to that of canopy 4, and can be manufactured in one forming operation along with canopy 4.

Canopy attachment blocks 80 are attached to the canopy support frame 77 as shown in FIGS. 8 and 8A. More specifically, canopy attachment blocks 80 are situated at the junction of firewall halves 22, 23 and floor 27 to receive canopy attachment bolts 81 which secure canopy 4 to the canopy support frame 77 as shown in FIGS. 1, 8, and 8A. Canopy 4 is slid over the front of fuselage 19 until mounting grommets 133 pass over the tops of attachment bolts 81. Grommets 133 are then pressed onto bolts 81 until the edges of floor 27 and firewall halves 22 and 23 seat firmly within mounting grooves 135 in mounting supports 128, 129.

Canopy 4 can be removed from canopy support frame 77 by slowly pulling the rear of canopy 4 outward until grommets 133 slip off of attachment bolts 81, or by removing attachment bolts 81 from attachment blocks 80.

Figure 9:
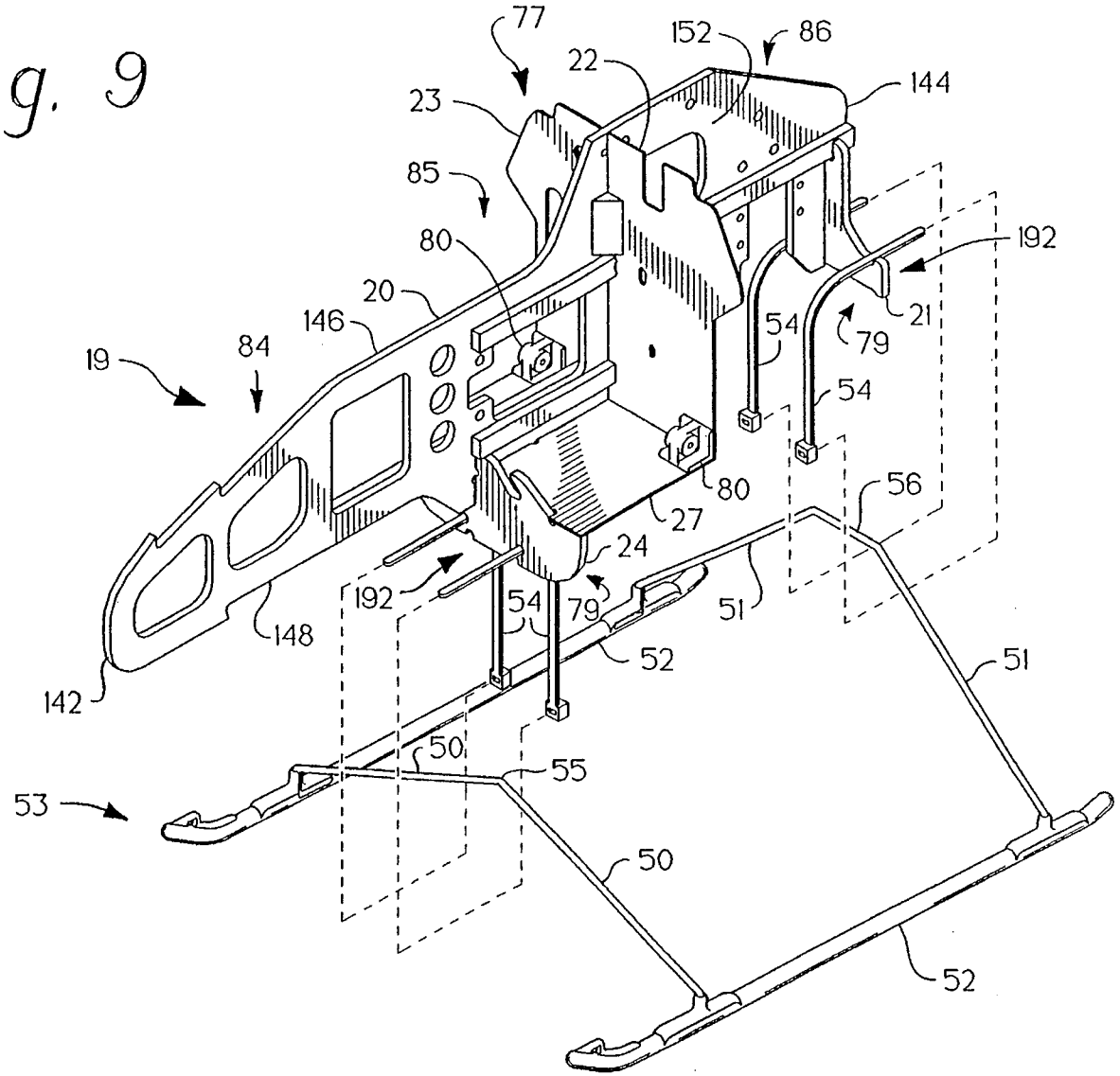
FIG. 9 is an exploded perspective view of the keel and canopy-supporting and landing gear-supporting fuselage structural elements mounted on the keel showing the attachment of the landing gear elements to the landing gear-supporting portion of the fuselage, with all other parts of the helicopter removed for clarity.

Landing gear bracket 21 and landing gear bulkhead 24 form a landing gear support 79 configured to support landing gear assembly 53 as shown in FIG. 9. Landing gear assembly 53 includes front struts 50, rear struts 51, and spaced-apart skids 52. Landing gear assembly 53 is rigidly mounted to fuselage 19 at landing gear mounting junctions 192 with cable ties 54. Central landing gear vertex 55 formed between two front struts 50 abuts the rearward face of landing gear bulkhead 24 and the lower edge of bulkhead reinforcement 25 attached to landing gear bulkhead 24 as shown in FIG. 3D. Central section 56 joining rear struts 51 is held firmly against the bottom edge of bracket 21 by cable ties 54.

It is understood that landing gear bulkhead 24, floor 27, keel 20, and firewall halves 22, 23 form a series of mutually supporting structural elements which greatly increase the strength and stiffness of fuselage 19. These structural elements also separate and protect forward section 84 of fuselage 19 inside canopy 4 from oily engine exhaust and airborne debris as shown in FIGS. 1 and 2. This is advantageous because radio receiver 12, battery 14, and servos 15 are housed in forward section 84.

Figures 10, 10A, 10B, 10C:
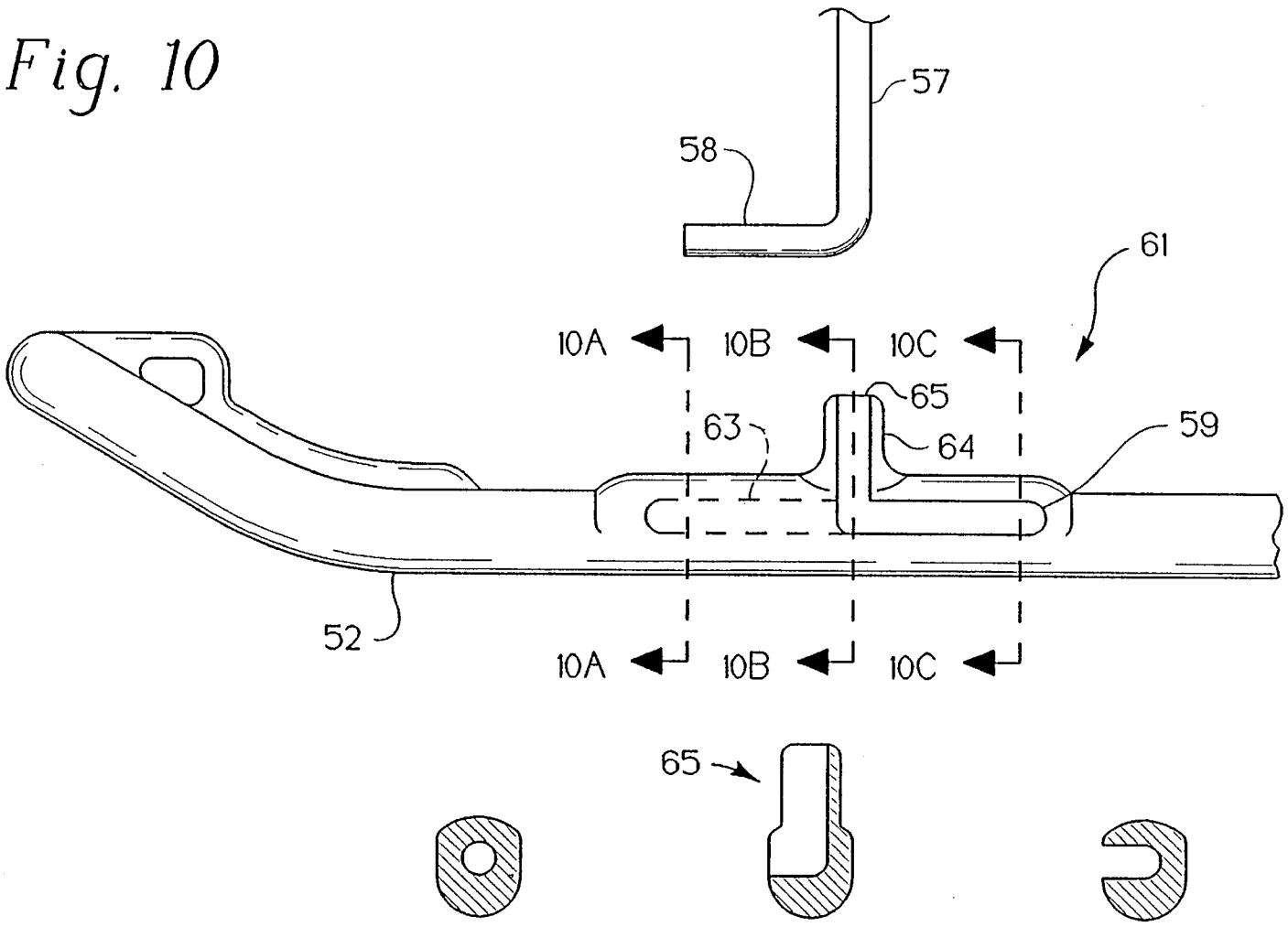
FIG. 10 is an enlarged side elevation view of a landing gear skid and a lower foot portion of a landing gear strut that attaches to the landing gear skid.
FIG. 10A is a sectional view taken along lines 10A—10A of FIG. 10 showing a hollow area formed in the landing gear skid.
FIG. 10B is a sectional view taken along lines 10B—10B of FIG. 10 showing a boot portion of the landing gear skid and a slot formed in the boot portion.
FIG. 10C is a sectional view taken along lines 10C—10C of FIG. 10 showing a slot formed in the landing gear skid.
Figure 11:
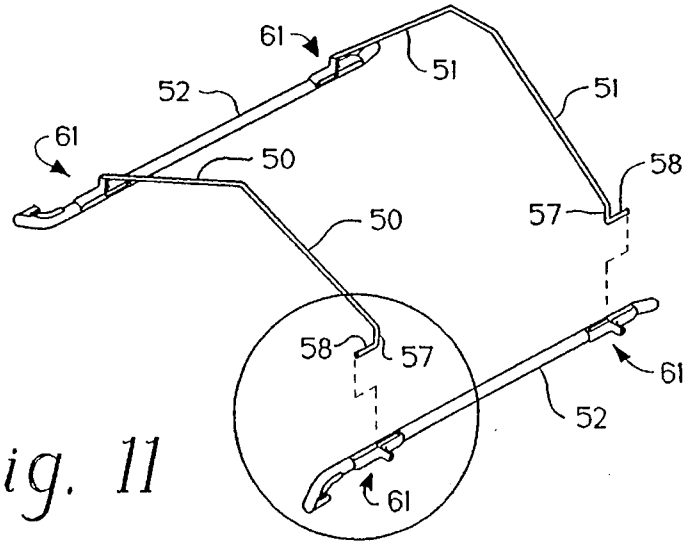
FIGS. 11–11C illustrate a preferred assembly sequence of the landing gear struts and landing gear skids for the model helicopter of FIGS. 1 and 2.
Figure 11A:
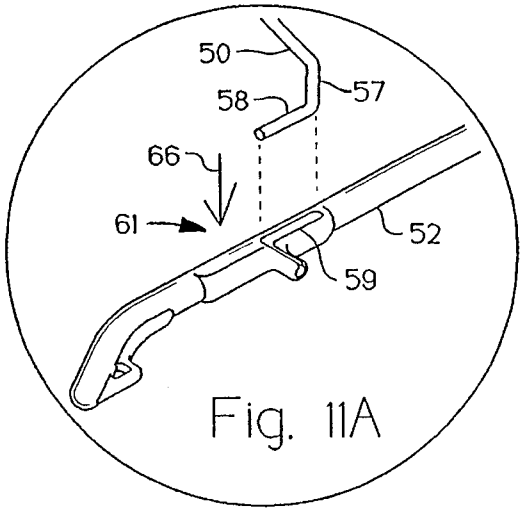
FIG. 11A is a perspective exploded view of the lower foot portion of a landing gear strut sliding into the slot of the landing gear skid.
Figure 11C:
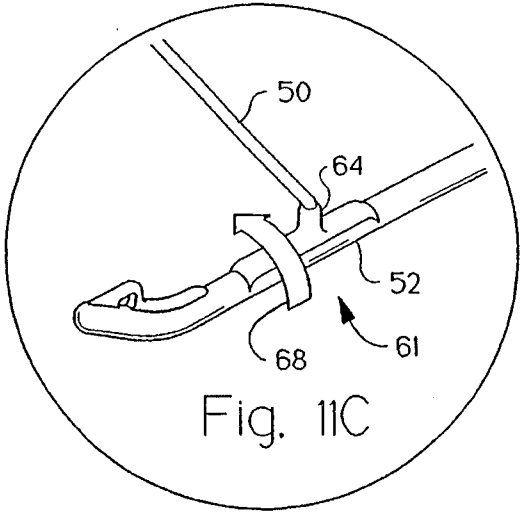
Figure 11B:
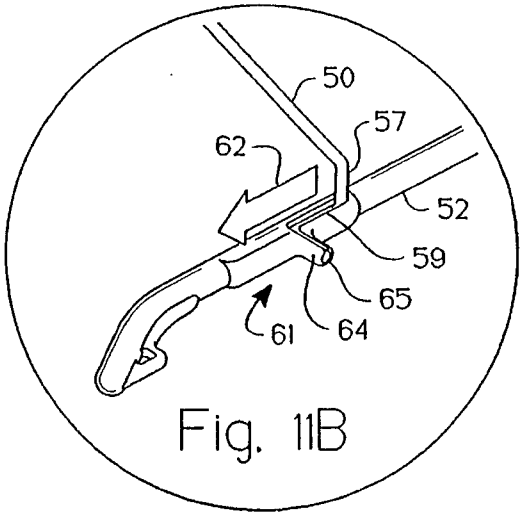
FIG. 11B is a perspective exploded view of the lower foot portion situated in the slot of the landing gear skid and sliding into the hollow area of the landing gear skid.

The details of landing gear skid 52/strut 50, 51 attachment is illustrated in FIGS. 10–11C. Each strut 50, 51 terminates in angled landing gear leg 57 and angled landing gear foot 58. Each skid 52 includes two spaced-apart landing gear strut attachment areas 61. Each landing gear strut attachment area 61 includes slot 59, hollow area 63, and boot-neck 64 having boot-neck slot 65 as shown in FIGS. 10–10C. FIG. 11A shows landing gear foot inserted in direction 66 into skid slot 59. Landing gear foot 58 slides in direction 62 into hollow area 63 as shown in FIG. 11B. Landing gear skid 52 is then rotated 90° in direction 68 about landing gear foot 58 in hollow area 63 as shown in FIG. 11C. This 90° rotation 69 forces landing gear leg 57 into skid boot-neck 64. Boot-neck slot 65 expands slightly to accommodate entry of landing gear leg 57 then closes securely around landing gear leg 57 to rigidly secure strut 50 to skid 52. Alternatively, hollow area 63 can be configured with a slot similar to boot-neck 64 to expand slightly and then close securely around landing gear foot 58, in which case a separate skid slot 59 would not be necessary. In preferred embodiments of the present invention, skid 52 is made of a rigid, impact resistant plastic material such as nylon.

The location of radio system 12 and engine drive train components on fuselage 19 is shown in FIGS. 12–13, with electric wiring between radio system 12 components removed for clarity. Servos 15 include tail rotor servo 69, throttle servo 70, fore-aft cyclic servo 71, and roll cyclic servo 72. All of servos 69–72 are positioned in forward section 84 of fuselage 19. Pushrods 73–76 and bellcrank 145 connecting the servos 69–72 with swashplate 78, engine 3, and tail rotor 2 are shown more clearly in FIG. 14. Tail rotor servo 69 is located within servo bay 33 in keel 20 with tail rotor pushrod 73 running nearly parallel to tail boom 67 back to the pitch control linkages of tail rotor 2 as shown in FIGS. 12–14. Mounting screws 160, 162 secure tail rotor servo 69 to keel 20 as shown, for example, in FIG. 12. A longitudinal tail rotor servo axis 176 extends between mounting screws 160, 162 substantially parallel to longitudinal helicopter axis 156 as shown, for example, in FIG. 12. Throttle servo 70 is also located in servo bay 33 with throttle pushrod 74 operably connected to the speed controls of engine 3. Mounting screws 164, 166 secure throttle servo 70 to keel 20 as shown, for example, in FIG. 12. A longitudinal throttle servo axis 178 extends between mounting screws 164, 166 substantially parallel to longitudinal helicopter axis 156 as shown, for example, in FIG. 12. Fore-aft cyclic servo 71 and roll cyclic servo 72, which are operably connected to swashplate 78 and control the tilt of main rotor 1, are located in servo bay 34 in close proximity to swashplate 78 so that fore/aft pushrod 75 and right/left pushrod 76 are short and direct. Mounting screws 168, 170 secure fore-aft cyclic servo 71 to keel 20 as shown, for example, in FIG. 12. A longitudinal fore-aft cyclic servo axis 180 extends between mounting screws 168, 170 substantially parallel to main rotor axis of rotation 5 as shown, for example, in FIG. 12. Mounting screws 172, 174 secure roll cyclic servo 72 to keel 20 as shown, for example, in FIG. 13. A longitudinal roll cyclic servo axis 182 extends between mounting screws 172, 174 substantially parallel to main rotor axis of rotation 5 as shown, for example, in FIG. 13.

The power train or main rotor drive components of helicopter 10 includes clutch assembly 89 having clutch pinion 92 and starter cone 90 mounted to engine 3 and driving main gear 91 secured to the lower end of main shaft 93. Clutch pinion 92 and engine 3 are situated along a vertical engine axis 184 as shown, for example, in FIGS. 12–15B. Vertical engine axis 184 is substantially parallel to main rotor axis of rotation 5 as shown, for example, in FIGS. 12 and 13. Vertical engine axis 184 is also known as an output shaft axis 184. Main shaft 93 extends through ball bearings in lower ball-bearing block 94 and upper ball bearing block 95 and is operably connected at its upper end to main rotor 1. Ball-bearing blocks 94, 95 are secured to keel 20 in rear portion 86 of fuselage 19.

Main shaft 93 transfers rotation for the power train to main rotor 1 and tail rotor 2. Main rotor 1 is directly connected to main shaft 93 thereby rotating with main shaft 93. Rotation is transferred from main shaft 93 to tail rotor 2 by tail rotor drive components which include crown gear 96, tail rotor pinion gear 97, and a tail rotor drive shaft (not shown). Crown gear 96 is securely fastened to main shaft 93 and engages tail rotor pinion gear 97 which is affixed to the tail rotor drive shaft (not shown) inside tail tube 67. The drive shaft is connected to tail rotor 2 thereby transmitting rotational motion of main shaft 93 to tail rotor 2. In operation, excess oil from engine 3 drips into clutch assembly 89 thereby lubricating interior clutch elements including the interior of clutch pinion 92. In preferred embodiments of the present invention, the engine is a COX TD 0.049/0.051.

The COX engine is a conventional two-stroke model airplane piston engine having a piston cylinder 186 extending along a piston cylinder axis 188 as shown, for example, in FIGS. 2, 14, and 15A. Piston cylinder axis 188 is oriented substantially perpendicular to keel 20 as shown, for example, in FIGS. 2 and 15A.

Fuel tank 103 is secured to keel 20 in rear section 86 of fuselage 19 as shown in FIG. 15A. Straps 104 made of long cable ties surround fuel tank 103 and pass through holes in keel 20 to secure fuel tank 103 to keel 20. Head portions 112 of additional cable ties 109 attach to the ends of straps 104 that extend through the holes in keel 20. After head portions 112 are attached to straps 104, tail portions 113 are removed. Fuel tank 103 has integral sump 106, filler tube 110 extending through the interior of fuel tank 103 into sump 106, standoffs 107, and is connected to engine 3 by fuel tubing 108 and fuel filter 111. Standoffs 107 shown, for example, in FIG. 15B extend between fuel tank 103 and keel 20 and act to fix fuel tank 103 in spaced-apart relation to elongated keel 20 as shown, for example, in FIG. 15A In the preferred embodiment, fuel tank 103 is molded of fuel-proof plastic material such as polyethylene and straps 103 are made of plastic material.

Figure 16A:
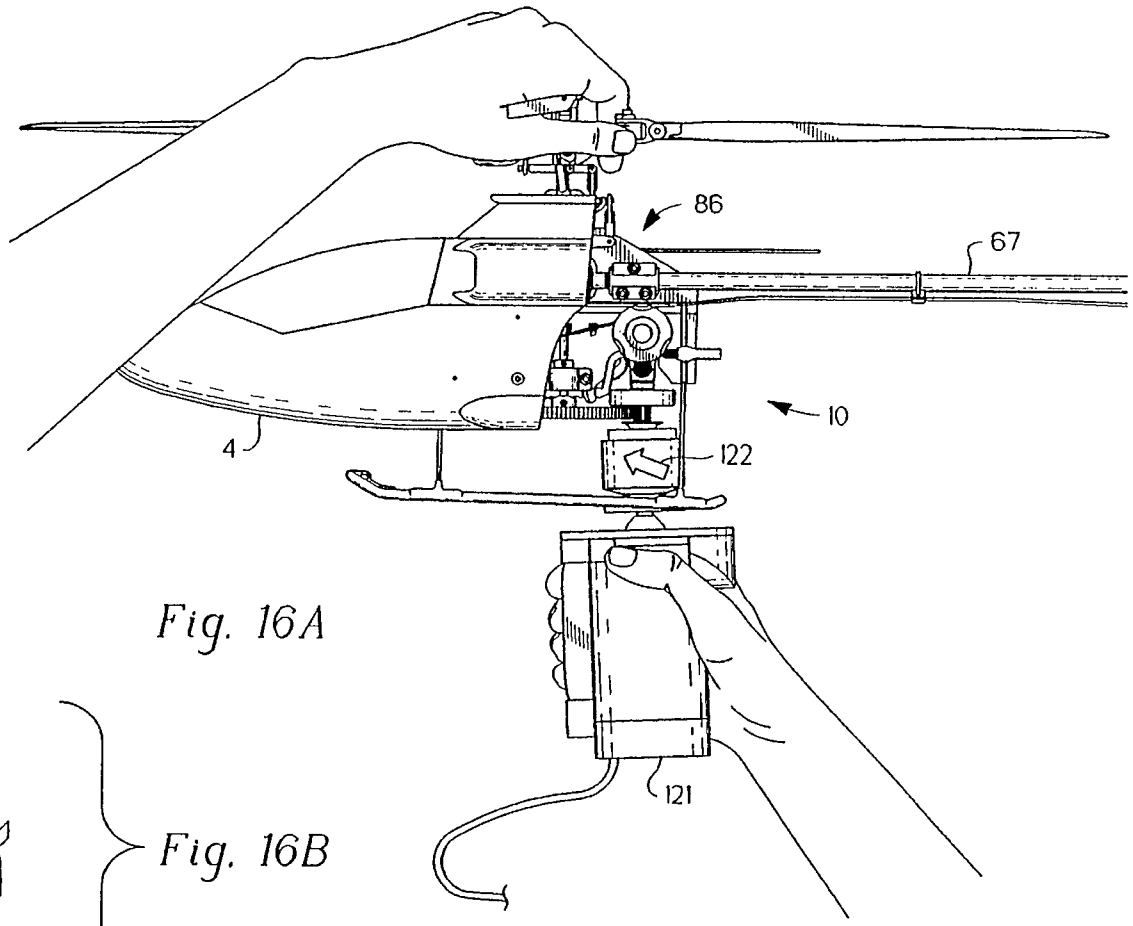
FIG. 16A is a side elevational view of the present invention showing application of an electric hand-held starting motor to an engine starter cone to start the model helicopter engine.
Figure 16B:
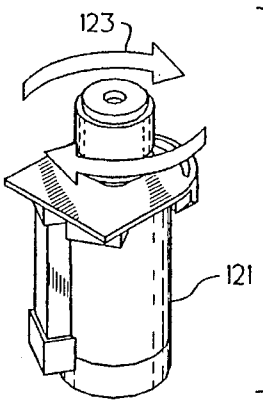
FIG. 16B is a perspective view of the electric hand-held starting motor.
Figure 17:
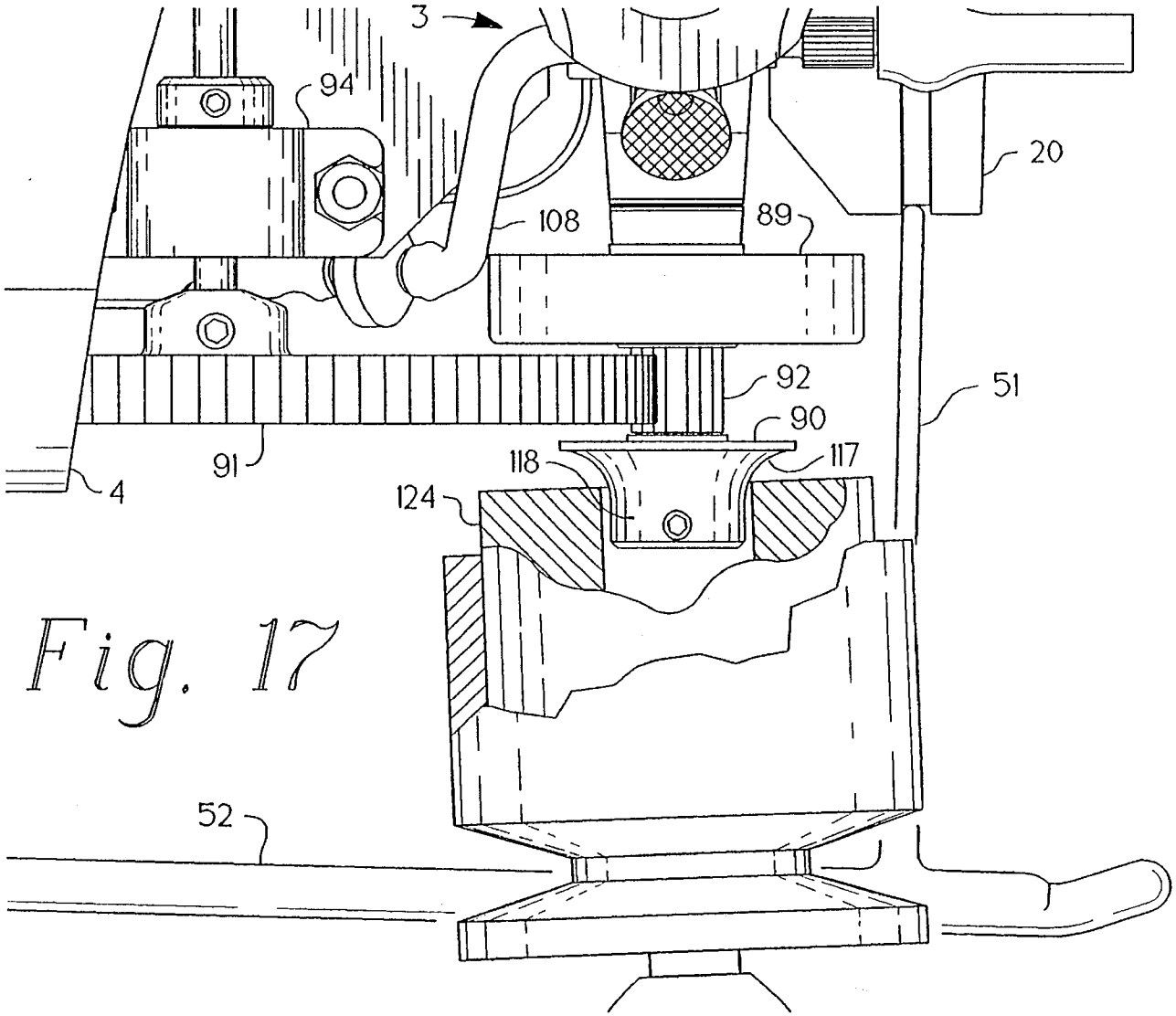
FIG. 17 is an enlarged side elevation view of a portion of the model helicopter shown in FIG. 16A, with starter motor elements shown in cut-away, and a landing gear strut and skid removed for clarity.
Figure 18A:
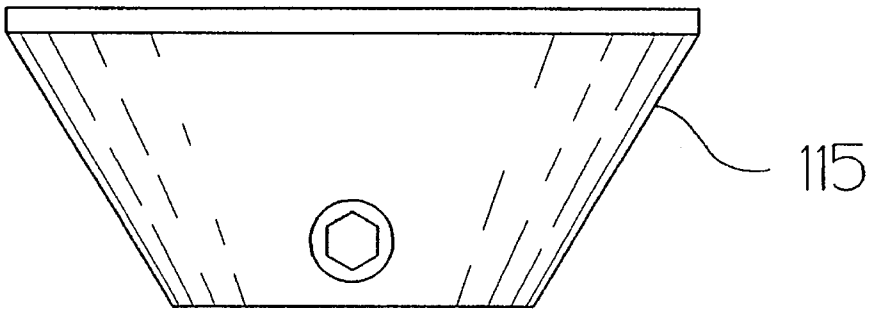
FIG. 18A is a side elevational view of a conventional starter cone.
Figure 18B:
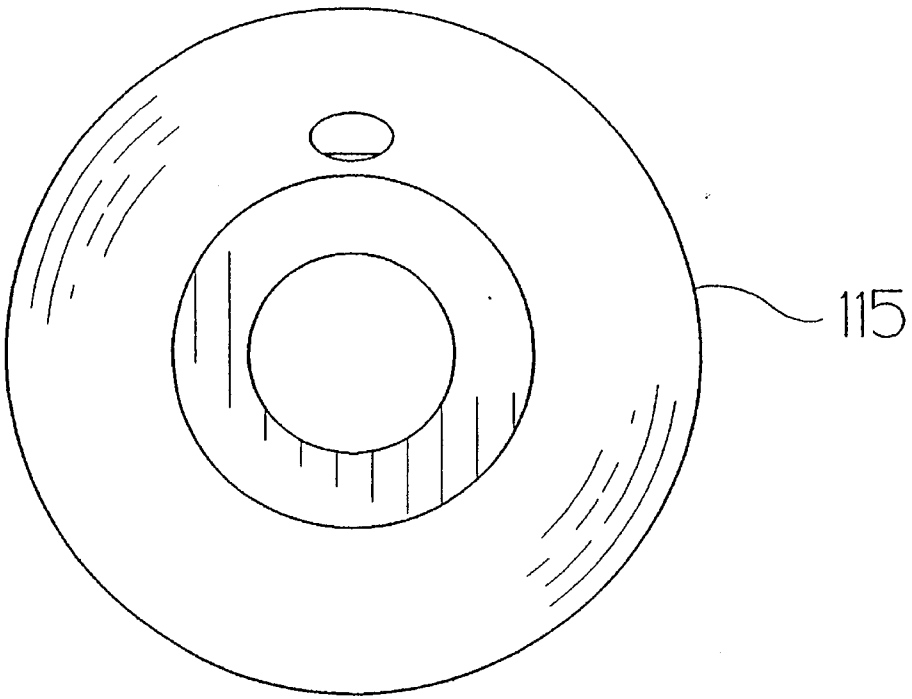
FIG. 18B is a top plan view of the conventional starter cone of FIG. 18A.

Engine 3 is typically started with electric starter motor 121. FIGS. 16 and 17 illustrate starting procedures for engine 3 and show an operator holding helicopter 10 and applying electric starter motor 121 (with the motor shaft rotating in starter rotation direction 123) firmly to starter cone 90 with force applied in the direction of contact arrow 122. Starter cone 90 is operably connected to the crankshaft of engine 3 so that rapid rotation of starter cone 90 causes engine 3 to start. Starter cone 90 has cylindrical portion 118 for centering soft rubber insert 124 of starter motor 121 onto starter cone 90 and concave surface 117 against which rubber insert 124 can apply the torque necessary to start engine 3. Conventional conical starter cone 115 as shown in FIG. 18 has no centering feature thereby allowing rubber insert 124 to track off-center and reducing the operator's ability to hold starter motor 121 firmly against starter cone 115 to transmit starting torque to engine 3. It will be understood that starter cone 115 can be advantageously employed to start engines in other applications that require transferring rotation from a starter motor such as for model cars and model boats.

Although the invention has been described and defined in detail with reference to certain preferred embodiments, variations and modifications exist within the scope and spirit of the invention as described and defined in the following claims.

We claim:

1. A fuselage structure for use on a model helicopter, the fuselage structure comprising a longitudinally extending elongated keel having a front, middle, and rear portion and means for supporting a canopy, landing gear, flight control system, and drive train, the supporting means including a support frame having a laterally extending floor arranged to lie perpendicular to the elongated keel, the floor having a forward end facing toward the front portion of the elongated keel and a rearward end facing toward the rear portion of the elongated keel, respectively, a front bulkhead appended to the elongated keel and the forward end of the floor, and a firewall appended to the elongated keel and the rearward end of the floor.

2. The fuselage of claim 1, wherein the supporting means further includes a rear bracket appended to the elongated keel, the landing gear includes a landing gear strut, and the landing gear strut is connected to one of the front bulkhead and rear bracket.

3. The fuselage structure of claim 1, wherein the model helicopter includes a front end, the elongated keel includes a front end, and the front end of the elongated keel is situated adjacent to the front end of the helicopter.

4. The fuselage structure of claim 1, wherein the flight control system is supported by one of the front portion and middle portion of the elongated keel.

5. A fuselage structure for use on a model helicopter having a front end, a longitudinal axis, a main rotor configured to rotate about a main rotor axis of rotation, and a canopy extending longitudinally from about the main rotor axis toward the front end of the model helicopter, the fuselage structure comprising a longitudinally extending elongated keel defined by a flat plate, the elongated keel having a front end and a rear end, the front end of the elongated keel being situated adjacent to the front end of the model helicopter within a canopy of a model helicopter so that the flat plate defining the elongated keel provides a structural backbone for the model helicopter.

6. The fuselage structure of claim 5, wherein the elongated keel further includes a front portion, middle portion, and rear portion, the fuselage structure further comprising a canopy support frame appended to the middle portion of the elongated keel, the canopy support frame includes a laterally extending floor arranged to lie perpendicular to the elongated keel, the floor further having a forward end facing toward the front portion of the elongated keel and a rearward end facing toward the rear portion of the elongated keel, respectively, and a firewall appended to the elongated keel and the rearward end of the floor.

7. The fuselage structure of claim 5, wherein the model helicopter further includes a landing gear assembly, the elongated keel further includes a front portion, middle portion, and rear portion, and the fuselage structure further comprises a landing gear support connected to the landing gear assembly and appended to the the middle and rear portions of the elongated keel.

8. The fuselage structure of claim 7, wherein the landing gear support includes a landing gear bulkhead appended to the middle portion of the elongated keel and a landing gear bracket appended to the rear portion of the elongated keel.

9. The fuselage structure of claim 5, wherein the model helicopter further includes a helicopter component selected from the group consisting essentially of a radio control system component, an engine system component, and a drive train component and the helicopter component is supported by the elongated keel.

10. The fuselage structure of claim 9, wherein the elongated keel is made of fiber-reinforced plastics material.

11. The fuselage structure of claim 9, wherein the elongated keel includes a rear end and a left-side keel surface and a right-side keel surface extending longitudinally between the front end and rear end of the elongated keel and each of the left-side keel surface and right-side keel surface are offset from the longitudinal axis of the model helicopter.

12. The fuselage structure of claim 11, wherein the model helicopter includes a main rotor configured to rotate about a main rotor axis of rotation and the right-side keel surface and left-side keel surface are offset from the main rotor axis of rotation.

13. The fuselage structure of claim 11, wherein the elongated keel includes a rear portion, the model helicopter further includes a tail rotor assembly linked to the rear portion of the elongated keel by a tail boom, the tail boom extends along the longitudinal axis of the model helicopter that is laterally offset from the left-side keel surface and right-side keel surface, and the tail boom is arranged to couple to the left-side keel surface.

14. The fuselage structure of claim 9, wherein the elongated keel is made of plywood.

15. The fuselage structure of claim 14, wherein the fuselage structure further comprises a canopy support frame appended to the elongated keel and configured to support the canopy.

16. The fuselage structure of claim 14, wherein the model helicopter further includes a landing gear assembly and the fuselage structure further comprises a landing gear support appended to the elongated keel and configured to attach to the landing gear assembly.

17. The fuselage structure of claim 16, wherein the model helicopter further includes a plastic cable tie coupling the landing gear assembly and landing gear support.

18. The fuselage structure of claim 14, wherein the helicopter further includes a landing gear assembly and a canopy and the fuselage structure further comprises a canopy support frame connected to the canopy and a landing gear assembly support connected to the landing gear assembly, the elongated keel includes a front portion and a rear portion, and the canopy support frame and landing gear assembly support include a laterally extending floor arranged to lie perpendicular to the elongated keel, the floor further includes a forward end facing toward the front portion of the elongated keel and a rearward end facing toward the rear portion of the elongated keel, respectively, a front bulkhead appended to the elongated keel and the forward end of the floor, and a firewall appended to the elongated keel and the rearward end of the floor.

19. The fuselage structure of claim 9, wherein the elongated keel comprises a single flat plate.

20. The fuselage structure of claim 9, wherein the elongated keel includes a front portion, middle portion, rear portion, and at least one aperture, the helicopter component is a radio control system component, and the radio control system component is situated in the at least one aperture formed in the elongated keel.

21. The fuselage structure of claim 20, wherein the model helicopter includes a main rotor which rotates about a main rotor axis of rotation and a main rotor shaft, the radio control system includes a plurality of radio control servo actuators, the at least one aperture forms a servo bay adjacent to the main rotor shaft, and at least one of the plurality of radio control servo actuators for one of fore-aft cyclic and right-left cyclic main rotor control is situated in the servo bay adjacent to the main rotor shaft.

22. The fuselage structure of claim 21, wherein the at least one of the plurality of radio control servo actuators for one of fore-aft cyclic and right-left cyclic main rotor control includes a longitudinal servo axis passing through mounting screws situated at each end of said radio control servo actuator, and the longitudinal servo axis is substantially parallel to the main rotor axis of rotation.

23. The fuselage structure of claim 20, wherein the radio control system component includes a plurality of radio control servo actuators, the at least one aperture forms a servo bay in the front portion of the elongated keel, and at least one of the plurality of radio control servo actuators for one of tail rotor control and throttle control is situated in the servo bay in the front portion of the elongated keel.

24. The fuselage structure of claim 23, wherein the model helicopter includes a longitudinal axis, the at least one of the plurality of radio control servo actuators for one of tail rotor control and throttle control includes a longitudinal servo axis passing through mounting screws situated at each end of said radio control servo actuator, and the longitudinal servo axis is substantially parallel to the longitudinal axis of the model helicopter.

25. The fuselage structure of claim 9, wherein the radio control system component includes at least one radio control battery and receiver.

26. The fuselage structure of claim 9, wherein the model helicopter further includes a main rotor, the engine system component includes an engine appended to the elongated keel, and the drive train component includes a clutch pinion for driving said main rotor.

27. The fuselage structure of claim 26, wherein the main rotor is supported by a main rotor shaft for rotation about a main rotor axis, and the engine is configured to rotate the clutch pinion to drive the mechanical drive train components and main rotor, and the clutch pinion is situated downward from the engine away from the main rotor.

28. The fuselage structure of claim 27, wherein the model helicopter further includes tail rotor drive train components, the tail rotor is connected to the main rotor shaft through tail rotor drive train components, and the clutch pinion is operably connected to the main rotor shaft to drive the main rotor and thereby to drive the tail rotor through the tail rotor drive train components.

29. The fuselage structure of claim 26, wherein the engine and clutch pinion are situated along a vertical engine axis substantially parallel to the main rotor axis.

30. The fuselage structure of claim 26, wherein the elongated keel further comprises a rear portion and the engine is appended to the rear portion of the elongated keel.

31. The fuselage structure of claim 26, wherein the elongated keel includes a left-side keel surface and a right-side keel surface, the engine is a piston engine comprising a piston cylinder having a piston cylinder axis extending lengthwise through the center of the piston cylinder, and the piston engine is appended to the elongated keel with the piston cylinder axis oriented substantially perpendicular to the left-side keel surface and right-side keel surface.

32. The fuselage structure of claim 9, wherein the elongated keel further includes a front portion, middle portion, and rear portion and the model helicopter further includes a fuel tank connected to the rear portion of the elongated keel.

33. The fuselage structure of claim 9, wherein the elongated keel further includes a bottom edge and a front portion, the model helicopter further includes a landing gear assembly having a landing gear strut appended to the fuselage structure at a forward landing gear mounting junction situated vertically along the bottom edge of the elongated keel and situated longitudinally between the main rotor axis of rotation and the front end of the elongated keel, the front portion of the elongated keel extends longitudinally between the landing gear mounting junction and the front end of the model helicopter, the helicopter component is the radio control system component, and the radio control system component is mounted to the front portion of the elongated keel.

34. The fuselage structure of claim 9, wherein the front end of the elongated keel defines the front end of the fuselage structure.

35. The fuselage structure of claim 9, wherein the elongated keel is defined by a single flat plate.

36. The fuselage structure of claim 9, wherein the radio control system component includes a first servo actuator and the first servo actuator is coupled to the elongated keel.

37. The fuselage structure of claim 36, wherein the first servo actuator is coupled to the elongated keel at a position between the main rotor axis of rotation and the front end of the elongated keel.

38. The fuselage structure of claim 37, wherein the radio control system component further includes a second servo actuator, the first and second servo actuators include first and second output control arms, and the first and second servo actuators are coupled to the elongated keel to position the first and second output control arms on opposite sides of the elongated keel.

39. The fuselage structure of claim 38, wherein the first servo actuator controls right-left cyclic function of the model helicopter and the second servo actuator controls fore-aft cyclic function of the model helicopter.

40. A fuselage structure for use on a model helicopter having a main rotor configured to rotate about a main rotor axis of rotation, a tail rotor, a longitudinal axis, and a canopy extending longitudinally from about the main rotor axis of rotation toward the front end of the model helicopter, the fuselage structure comprising a front end of the fuselage structure, a rear end of the fuselage structure, and a longitudinally vertically extending elongated keel defined by a flat plate and including a front end situated to lie within a canopy of a model helicopter, the front end of the elongated keel defining the front end of the fuselage structure.

41. A model helicopter having a longitudinal axis, the model helicopter comprising a fuselage structure including a front end, a rear end, and a longitudinally vertically extending elongated keel defined by a flat plate, the elongated keel including a front end defining the front end of the fuselage structure, and a first helicopter component selected from the group consisting essentially of a radio control system component, an engine system component, and a drive train component, the first helicopter component being connected to the elongated keel.

42. The model helicopter of claim 41, wherein the elongated keel includes a left-side keel surface and a right-side keel surface, the model helicopter further comprises a second helicopter component, and the first helicopter component is appended to the left-side keel surface and the second helicopter component is appended to the right-side keel surface.

43. The model helicopter of claim 41, wherein the elongated keel is made substantially of a fiber-reinforced plastics material.

44. The model helicopter of claim 41, wherein the elongated keel is made substantially of plywood.

45. The model helicopter of claim 41, wherein the helicopter component is a radio control system component selected from the group consisting essentially of a radio receiver, a battery, and a servo actuator.

46. The model helicopter of claim 45, wherein the elongated keel is formed to include an aperture and the helicopter component is mounted in the aperture formed in the elongated keel.

47. A model helicopter having a longitudinal axis, the model helicopter comprising a main rotor configured to rotate about a main rotor axis of rotation, a tail rotor, a fuselage structure including an elongated keel having a front end, a rear end, a first section, and a second section, the first section extending from the main rotor axis of rotation to the front end a first length in a first direction substantially parallel to the longitudinal axis of the model helicopter and away from the tail rotor, the second section extending from the main rotor axis of rotation to the rear end a second length in a second direction opposite from the first direction substantially parallel to the longitudinal axis of the model helicopter and toward the tail rotor, the first length being greater than the second length, and a helicopter component selected from the group consisting essentially of a radio control system component, a power plant component, and a drive train component, the helicopter component being connected to the elongated keel.

48. The model helicopter of claim 47, further comprising a front end and wherein the elongated keel includes a front end situated to lie adjacent to the front end of the model helicopter.

49. The model helicopter of claim 47, wherein the elongated keel is defined by a single flat plate.

50. The model helicopter of claim 49, wherein the first length is about two times longer than the second length.

51. A model helicopter having a longitudinal axis, the model helicopter comprising a fuselage structure including a vertically extending elongated keel defined by a flat plate, the elongated keel including a bottom edge, top edge, front end, and rear end, the elongated keel being oriented in parallel relation to the longitudinal axis, and the elongated keel extending vertically between the bottom edge and the top edge and longitudinally between the front end and the rear end, and a radio control system component from the group consisting essentially of a radio receiver and a battery, the radio control system component being mounted directly to the vertically extending elongated keel.

52. The model helicopter of claim 51, wherein the elongated keel includes a right-side keel surface and a left-side keel surface and the radio receiver is mounted on one of the right-side keel surface and left-side keel surface and the battery to the other of the right-side keel surface and left-side keel surface.

53. The model helicopter of claim 51, wherein the radio control system component includes a servo actuator and the servo actuator is mounted directly to the vertically extending elongated keel.

54. The model helicopter of claim 51, wherein the elongated keel is a single flat plate.

55. A model helicopter having a longitudinal axis, the model helicopter comprising a longitudinally extending elongated keel defined by a single flat plate, the elongated keel being arranged to define a keel plane offset from the longitudinal axis of the model helicopter, and the elongated keel including a front end, a rear end, a left-side keel surface, and a right-side keel surface, and a first servo actuator mounted to the elongated keel, the first servo actuator including a first output control arm offset from the keel plane, the first servo actuator being appended to one of the left-side keel surface and right-side keel surface, and one of the left-side keel surface and right-side keel surface faces toward the first output control arm and the longitudinal axis of the model helicopter.

56. The model helicopter of claim 55, wherein the elongated keel is formed to include an aperture and the first servo actuator extends through the aperture formed in the elongated keel.

57. The model helicopter of claim 55, wherein the elongated keel is made substantially of plywood.

58. The model helicopter of claim 55, wherein the elongated keel is made substantially of fiber-reinforced plastics material.

59. The model helicopter of claim 55, further comprising a piston engine including a piston cylinder extending along a piston cylinder axis and the piston engine being mounted to the elongated keel with the piston cylinder axis oriented substantially perpendicular to the keel plane of the elongated keel.

60. The model helicopter of claim 59, further comprising a landing gear assembly, a main rotor rotatable about a main rotor axis of rotation, and a fuselage structure including the elongated keel and a landing gear bulkhead appended to the elongated keel at a position situated to lie between the main rotor axis of rotation and the front end of the elongated keel, the landing gear bulkhead being connected to the landing gear assembly at a landing gear mounting junction, and wherein the elongated keel includes a bottom edge, a top edge, a front portion, a rear portion, and a middle portion separating the front portion and rear portion, the middle portion of the elongated keel extending longitudinally between first and second lines, the first line extending from the landing gear mounting junction to the top edge of the elongated keel substantially parallel to the main rotor axis of rotation, the second line extending from the bottom edge of the elongated keel to the top edge of the elongated keel substantially parallel to the main rotor axis of rotation and longitudinally between the main rotor axis of rotation and the first line, the front portion of the elongated keel extending longitudinally between the first line and the front end of the elongated keel, the rear portion of the elongated keel extending longitudinally between the second line and the rear end of the elongated keel, and the piston engine is supported in the rear portion.

61. The fuselage structure of claim 60, wherein the first servo actuator is connected to the middle portion of the elongated keel.

62. The fuselage structure of claim 60, wherein the first servo actuator is situated in the front portion of the elongated keel.

63. The fuselage structure of claim 59, wherein the piston engine includes an output shaft axis and the piston engine is appended to the elongated keel so that the output shaft axis is oriented in substantially parallel relation to the main rotor axis of rotation.

64. The model helicopter of claim 55, wherein the first servo actuator is supported by the elongated keel at a location between the main rotor axis of rotation and the front end of the elongated keel.

65. The model helicopter of claim 55, further comprising a second servo actuator having a second output control arm and the second servo actuator is appended to the elongated keel to position the first and second output control arms on opposite sides of the elongated keel.

66. The model helicopter of claim 65, wherein the first servo actuator controls fore-aft cyclic function of the model helicopter and the second servo actuator controls right-left cyclic function of the model helicopter.

67. The model helicopter of claim 55, further comprising a landing gear strut and a cable tie linking the landing gear strut to the elongated keel.

68. The model helicopter of claim 55, further comprising a cable tie and a fuel tank situated to lie in close proximity to one of the left-side keel surface and the right-side keel surface and the cable tie links the fuel tank to the elongated keel.

69. The model helicopter of claim 55, further comprising a longitudinally extending tail boom supporting a tail rotor and the tail boom is supported by and coupled to the elongated keel.

70. A model helicopter having a longitudinal axis, the model helicopter comprising a main rotor configured to rotate about a main rotor axis of rotation, a landing gear assembly having a landing gear strut, a fuselage structure including an elongated keel defined by a single flat plate, the single flat plate having a front end, rear end, top edge, and bottom edge, the landing gear strut being coupled to the fuselage structure at a landing gear mounting junction positioned to lie adjacent to the bottom edge of the elongated keel and between the front end and the main rotor axis of rotation, and the elongated keel further including a front portion situated between the front end of the elongated keel and a first line extending from the landing gear mounting junction to the top edge of the elongated keel and lying parallel to the main rotor axis of rotation, and a radio control system component coupled to the front portion of the elongated keel.

71. The model helicopter of claim 70, wherein the elongated keel is made substantially of plywood.

72. The model helicopter of claim 70, wherein the elongated keel is made substantially of a fiber-reinforced plastics material.

73. The model helicopter of claim 70, wherein the elongated keel defines a keel plane and further comprising a piston engine including a piston cylinder having a piston cylinder axis extending through the center of the piston cylinder substantially perpendicular to the keel plane.

74. The model helicopter of claim 73, wherein the piston engine further includes an output shaft having an output shaft axis and the piston engine is supported by the elongated keel so that the output shaft axis is substantially parallel to the main rotor axis of rotation.

75. The model helicopter of claim 70, wherein the elongated keel is formed to include an aperture and the radio control system component is situated in the aperture.

76. The model helicopter of claim 75, wherein the radio control system component includes a first servo actuator for fore-aft cyclic control of the main rotor and a second servo actuator for left-right cyclic control of the main rotor and one of the first and second servo actuators for fore-aft cyclic control and left-right cyclic control is situated to lie in the aperture formed in the elongated keel.

77. The model helicopter of claim 76, wherein the elongated keel further includes a rear portion and a middle portion separating the front portion and the rear portion, the middle portion extends between the first line and a second line, the second line extends vertically from the bottom edge of the elongated keel to the top edge of the elongated keel parallel to the first line and is positioned longitudinally between the first line and the main rotor axis of rotation, and the aperture is formed in the middle portion of the elongated keel.

78. The model helicopter of claim 75, wherein the radio control system component includes a first servo actuator for tail rotor control and a second servo actuator for throttle control to adjust the lift produced by the main rotor and one of the first and second servo actuators for tail rotor control and throttle control is situated to lie in the aperture formed in the elongated keel.

79. The model helicopter of claim 78, wherein the aperture is formed in the front portion of the elongated keel.

80. The model helicopter of claim 70, wherein the radio control system component includes one of a radio receiver and a battery and the one of the radio receiver and battery is mounted directly to the elongated keel adjacent to the front end.

81. The model helicopter of claim 70, further comprising a power plant to drive the main rotor and the power plant includes an output shaft axis that is substantially parallel to the main rotor axis of rotation.

82. The model helicopter of claim 81, wherein the main rotor includes a main rotor shaft, the model helicopter further comprises drive train components including main rotor drive components connecting the power plant to the main rotor shaft and tail rotor drive components connecting the main rotor shaft to the tail rotor, the main rotor drive components include means for transferring rotational motion from the power plant to the main rotor shaft, and the tail rotor drive components include means for transferring rotational motion from the main rotor shaft to the tail rotor.

83. The model helicopter of claim 70, wherein the elongated keel includes a right-side keel surface and a left-side keel surface and further comprising a fuel tank situated to lie in close proximity to and to one side of one of the right-side keel surface and left-side keel surface and a fuel tank strap substantially surrounding the fuel tank and linking the fuel tank to the elongated keel.

84. The model helicopter of claim 83, further comprising a standoff and the fuel tank being connected to the elongated keel through the standoff to space apart the fuel tank from the elongated keel.

85. The model helicopter of claim 83, wherein the fuel tank strap is a plastic cable tie.

86. The model helicopter of claim 70, wherein the radio control system component comprises one of a throttle control servo actuator to adjust the lift produced by the main rotor and a tail rotor; control servo actuator and the one of throttle control servo actuator and tail rotor control servo actuator includes a longitudinal servo axis oriented to lie in substantially parallel relation to the longitudinal axis of the model helicopter.

87. The model helicopter of claim 70, wherein the radio control system component includes one of a fore-aft cyclic control servo actuator and a left-right cyclic control servo actuator and wherein the elongated keel further includes a rear portion and a middle portion separating the front portion and the rear portion, the middle portion extends between the first line and a second line, the second line extends vertically from the bottom edge of the elongated keel to the top edge of the elongated keel parallel to the first line and is positioned longitudinally between the first line and the main rotor axis of rotation, and the one of fore-aft cyclic control servo actuator and left-right cyclic control servo actuator is appended to the elongated keel in the middle portion.

88. The model helicopter of claim 70, wherein the radio control system component includes a first servo actuator having a first output control arm and a second servo actuator having a second output control arm and the first and second servo actuators are appended to the elongated keel to position the first and second output control arms on opposite sides of the elongated keel.

89. The model helicopter of claim 88, wherein the first servo actuator controls fore-aft cyclic function of the model helicopter and the second servo actuator controls left-right cyclic function of the model helicopter.

90. The model helicopter of claim 70, further comprising a tail rotor and a tail boom supporting the tail rotor and being coupled adjacent to the rear end of the elongated keel.

91. The model helicopter of claim 70, wherein the fuselage structure includes a front end and the front end of the elongated keel defines the front end of the fuselage structure.

92. The fuselage structure of claim 14, further comprising a keel stiffener appended to the elongated keel, the keel stiffener extending in substantially parallel relation to the right-side keel surface and left-side keel surface.

* * * * *